US012419373B2

(12) United States Patent
Bergman

(10) Patent No.: US 12,419,373 B2
(45) Date of Patent: Sep. 23, 2025

(54) RECLOSABLE CLOSURE

(71) Applicant: Michael Bergman, Somerville, MA (US)

(72) Inventor: Michael Bergman, Somerville, MA (US)

( * ) Notice: Subject to any disclaimer, the term of this patent is extended or adjusted under 35 U.S.C. 154(b) by 0 days.

(21) Appl. No.: 18/772,162

(22) Filed: Jul. 13, 2024

(65) Prior Publication Data

US 2024/0365897 A1 Nov. 7, 2024

Related U.S. Application Data

(63) Continuation-in-part of application No. PCT/US2023/010823, filed on Jan. 13, 2023.

(60) Provisional application No. 63/569,289, filed on Mar. 25, 2024, provisional application No. 63/433,671, filed on Dec. 19, 2022, provisional application No. 63/299,367, filed on Jan. 13, 2022, provisional application No. 63/299,373, filed on Jan. 13, 2022.

(51) Int. Cl.
*A41F 1/00* (2006.01)

(52) U.S. Cl.
CPC ..... *A41F 1/002* (2013.01); *A44D 2203/00* (2013.01)

(58) Field of Classification Search
CPC ..... A41F 1/002; A44D 2203/00; Y10T 24/32; A44B 19/02; H01F 7/0263; A45C 13/1069
See application file for complete search history.

(56) References Cited

U.S. PATENT DOCUMENTS

| | | | | |
|---|---|---|---|---|
| 4,399,595 | A * | 8/1983 | Yoon | A41F 1/002 24/303 |
| 5,080,380 | A | 1/1992 | Nakagawa et al. | |
| 6,163,883 | A | 12/2000 | Hong | |
| 7,304,600 | B2 | 12/2007 | Nehls et al. | |
| 9,277,661 | B2 * | 3/2016 | Andre | H05K 5/0221 |
| 9,330,825 | B2 * | 5/2016 | Sarai | H01F 7/02 |
| 10,130,130 | B2 * | 11/2018 | Roberman | A41F 1/002 |
| 10,334,900 | B2 | 7/2019 | Gladish et al. | |

(Continued)

FOREIGN PATENT DOCUMENTS

| | | | |
|---|---|---|---|
| CN | 106028863 | A | 10/2016 |
| CN | 208708847 | U | 4/2019 |

(Continued)

OTHER PUBLICATIONS

European Patent Office; Patnet Abstracts of Japan; 2001000210; Jan. 9, 2001; Electromagnetic Button; 1 page.

(Continued)

*Primary Examiner* — Jason W San
*Assistant Examiner* — Rowland Do
(74) *Attorney, Agent, or Firm* — Bergman LLC; Michael Bergman

(57) ABSTRACT

A closure includes a first magnetic assembly, a second magnetic assembly and an actuator coupled to the first magnetic assembly and the second magnetic assembly. The actuator is arranged to reconfigure the first and second magnetic assemblies from a closed configuration in which the magnetic assemblies are attracted to one another to an open configuration in which the magnetic assemblies are repelled from one another. Where the magnetic assemblies are coupled to respective sides of an aperture in a flexible substrate, operation of the actuator will tend to open and close the aperture.

19 Claims, 13 Drawing Sheets

(56) References Cited

U.S. PATENT DOCUMENTS

| | | | | |
|---|---|---|---|---|
| 10,582,734 | B1 * | 3/2020 | Price | A41F 1/002 |
| 10,586,641 | B2 * | 3/2020 | Good | H01F 7/0263 |
| 10,653,209 | B2 | 5/2020 | Pratt et al. | |
| 10,709,212 | B1 * | 7/2020 | Bharadwaj | A44B 19/08 |
| 11,246,383 | B2 * | 2/2022 | Beckman | A41F 1/002 |
| 11,375,789 | B2 | 7/2022 | Weber | |
| 2006/0112523 | A1 * | 6/2006 | Deto | A41F 1/002 24/303 |
| 2007/0138806 | A1 * | 6/2007 | Ligtenberg | G06F 1/1616 292/251.5 |
| 2007/0277353 | A1 * | 12/2007 | Kondo | A45C 13/1069 24/303 |
| 2008/0184737 | A1 * | 8/2008 | Wiseman | A63H 33/26 63/3 |
| 2009/0184789 | A1 | 7/2009 | Lee | |
| 2011/0302749 | A1 * | 12/2011 | Yazbeck | A44B 19/24 24/405 |
| 2014/0034080 | A1 | 2/2014 | Paquet et al. | |
| 2015/0237748 | A1 | 8/2015 | Andre et al. | |
| 2015/0279534 | A1 | 10/2015 | Boudouris et al. | |

FOREIGN PATENT DOCUMENTS

| | | | |
|---|---|---|---|
| JP | 2001 000210 | A | 1/2001 |
| JP | 6 377875 | B1 | 8/2018 |

OTHER PUBLICATIONS

European Patent Office Patent Translate; Abstract JP6377875B1; 1 page.

International Search Report and Written Opinion of the International Searching Authority (14 pp).

Joseph Slote, The Zipper—A History, YouTube.com, Jul. 28, 2014, https://www.youtube.com/watch?v=N2f6-t9YmGU.

Niler Taylor, Zip Your Own Dress!!! Diy Zipper Assistant, YouTube.com, Dec. 6, 2018, https://www.youtube.com/watch?v=SJFIFmPUelc.

YKK Americas Group, YKK Presents "Auto Camping", YouTube.com, Nov. 6, 2017, https://www.youtube.com/watch?v=XySUNapUAHg.

Alison A. Nieder, YKK's Remote-Zip Future, California Apparel News, TLM Publishing Inc, Nov. 9, 2017, https://www.apparelnews.net/news/2017/nov/09/ykks-remote-zip-future/.

Remote Control Zipper Sliders, Aero Design & Mfg. Co., https://www.aerostich.com/remote-control-zipper-sliders.html.

Just Vlad, No Tie Shoelaces—Kids & Adults, Nov. 27, 2018, YouTube.com, https://www.youtube.com/watch?v=-VIDgN5T1nA.

Chinese Kitchen, Zubits Magnetic Shoe Closures Instruction Video for Installation, Apr. 17, 2017 YouTube.com, https://www.youtube.com/watch?v=w8aD6-8aGgw.

Johnsiebert, Magnetic Zipper—Patent Pending—Say Goodbye To Zippers!!!, Kickstarter, Sep. 26, 2016, https://www.kickstarter.com/projects/1049761729/magnetic-zipper-patent-pending-say-goodbye-to-zipp.

Technology Offer: Advanced Magnetic Zipper For Industrial And Consumer Applications, Max Planck Innovation, Ammalienstr. 33, 80799 Munich, Germany, File No. MI 0705-4974-BC.

Veritasium, Why Machines That Bend Are Better,www.YouTube.com, Mar. 12, 2019, https://www.youtube.com/watch?v=97t7Xj_iBv0.

Yuanping Song, et al., Additively Manufacturable Micro-Mechanical Logic Gates, Nature Communications, 10:882, 2019 https://doi.org/10.1038/s41467-019-08678-0.

John. T. Wen, Design of Compliant MEMS Grippers for Micro-Assembly Tasks, proceedings of the 2006 IEEE/RS J International Conference on Intelligent Robots and Systems, Oct. 9-15, 2006, Beijing, China, 1-4244-0259-X/06/$20.00.

Ideal Fastener Corporation, Magzip, https://idealfastener.com/magzip/.

Magnetic Adaptive Clothing for Dexterity/Mobility Impaired,Magna-Ready, https://magnaready.com/.

E=MC2_Baby Clothes Made Easier with Magnets, Jan. 22, 2022 easymagnetic close.com.

Never Bend Down to Put on Shoes Again, Kizic, YouTube.com, Oct. 21, 2020, https://www.youtube.com/watch?v=f9ey-j9xGIQ.

* cited by examiner

RECLOSABLE CLOSURE

RECLOSABLE CLOSURE

The present application is a continuation-in-part of PCT patent application number PCT/US 2023/010823, filed Jan. 13, 2023 entitled RECLOSABLE CLOSURE; which PCT patent application claims the benefit of U.S. provisional patent application 63/299,367 filed Jan. 13, 2022 entitled BI-STABLE CLOSURE APPARATUS; and claims the benefit of U.S. provisional patent application 63/299,373 filed Jan. 13, 2022 entitled BI-STABLE CLOSURE APPARATUS; and claims the benefit of U.S. provisional patent application 63/433,671 filed Dec. 19, 2022 entitled RECLOSABLE CLOSURE; and the present application claims benefit of U.S. provisional patent application 63/569,289 filed Mar. 25, 2024 and entitled RECLOSABLE CLOSURE WITH MECHANICAL ENGAGEMENT FEATURES; the disclosures of all of the foregoing being herewith incorporated by reference in their entireties.

FIELD OF THE INVENTION

The present invention relates to methods, systems and apparatus for securing closure of an aperture in a substrate and, more particularly, to closure devices for clothing, shoes, and other systems having a physical aperture.

SUMMARY

The ability to temporarily close an aperture has a wide variety of applications in a wide variety of human undertakings. For example, being able to close a garment for purposes of modesty, keeping out weather, and maintaining warmth, makes a garment substantially more effective.

A variety of mechanisms and apparatus are available for effecting such closure. For example, zippers, buttons, hooks, snaps and integrated hook and loop fasteners (e.g., Velcro®) have all been employed regularly in closing apertures in human clothing.

For many users, however, operation of such closure mechanisms can be problematic. Generally, these devices require positioning of a wearer's hands in proximity to the aperture, and often over the entire expanse of the aperture, in order to effectively operate the closure mechanism.

While some individuals find this poses no problem, for many others, limited range of motion, motor control, and other issues, can make operation of these mechanisms difficult. For example, people affected by pregnancy, obesity, injury, paralysis, age and other disabilities will find the operation of conventional closure such as buttons and zippers, Velcro and button loops very difficult.

Awareness of these difficulties among the affected populations, and those in regular contact with them, has led to a variety of undertakings that have attempted to solve this problem. Notwithstanding long public awareness of the problem, and repeated efforts to solve it, none of those efforts have been effective to the point where they have elicited mass adoption.

There remains a need to have a temporary closure for a wide variety of garments and other applications that offers ease of operation and, in particular, operation of a location more or less remote from the aperture to be closed.

Having considered the foregoing, the inventor of the present invention has arrived at solutions and inventions providing novel responses to the problems discussed. Many of these solutions relate to the field of adaptive fashion, that is garments and footwear of various descriptions including, without limitation, innerware and outerwear, pants, shirts, blouses, skirts and dresses, hosiery, underwear, jumpsuits, capes, shoes, slippers and boots, mittens, gloves, protective sleeves, gators, hats, scarves, neck warmers and neck protectors that are readily employed without assistance by those of limited physical and/or mental capacity. Many other fields are adapted to benefit from the inventions described below, however. In reviewing the various aspects, embodiments and characterizations of the invention, one of skill in the art will understand that these various fields will include, for example and without limitation, storage containers such as special-purpose and/or general-purpose storage chests, such as refrigerators, freezers, vacuum dewars, shipping boxes, shipping crates, storage totes, aircraft unit load devices; laboratory apparatus including fume hoods, dewar insulating blankets, centrifuge covers, incubator covers, blast shields, instrument covers, and animal enclosures; vehicles and vehicle apparatus such as convertible tops, doors, hoods, trunks, box truck bodies, trailer bodies, shipping containers, vehicle internal dividers including vehicle curtains such as, for example, aircraft cabin curtains, ship cabin curtains, engine covers, cargo covers, maritime hatches and other maritime apparatus, vehicle storage covers and vehicle decorative and functional apparatus such as hubcaps, air filter enclosures, seat covers, carpeting and roof liners; spacecraft related apparatus including heat shields, dust and detritus exclusion covers, parachute chamber covers, spacecraft hatches; spacesuits, storage unit enclosures, sleeping enclosures, shower enclosures, exercise apparatus retention devices, camera covers, and window covers; architectural and decorative apparatus of a functional and/or decorative nature including, for example, furniture dust covers, room dividers, curtains, blinds and shades, awnings, parasols and umbrellas, swimming pool covers, window apparatus; maintenance related apparatus including temporary dust curtains, drop cloths, tool storage boxes and totes, machine-tool covers, roll-up and other tool caddies; luggage and bag related apparatus including, for example, suitcases, backpacks, purses, satchels, duffel bags, briefcases and attache cases, hotel and other luggage carts, dollies, and hand trucks; camping apparatus including tents, recreational vehicles, sleeping bags, kit bags, totes for cooking gear; athletic pads, athletic clothing, and specialized athletic footwear; facilities apparatus including manhole curtains, electrical cabinet curtains including flash-guard curtains; air control curtains including loading dock curtains, doorway curtains, walk-in freezer curtains, garage door curtains; industrial apparatus including dust and spray control curtains, welding curtains and other light and fire control curtains, machine covers, machine tool enclosures, dust collector enclosures, dust collector bags, filter retention screens, flocking collection dams, cable and hose control wraps, robot joint covers; gardening, landscaping and agricultural apparatus including thermal blankets and greenhouse shades, hydroponics curtains, crop shields, tractor cabins; theater and cinema apparatus including theater sets, theater curtains, theater patron access control items; animal enclosures; electronics and clean room control apparatus including clean room partitions and airlock partitions; and anywhere a zipper, hook and loop fastener, or other electrostatic or magnetic closure has been employed and/or might be employed to good effect. Again, the foregoing listing is intended to be merely exemplary and not exclusive.

In certain embodiments of the invention, the closure device will include a first structural member with a first longitudinal axis, a second structural member with a second longitudinal axis, and an actuator mechanism. In some embodiments, the actuator mechanism is coupled to respective first ends of the first and second structural members.

In certain embodiments, the first structural member has a first plurality of magnets or magnetic regions, where the first plurality of magnets or magnetic regions have respective magnetic polarities and respective magnetic axes disposed generally transverse to the first longitudinal axis. In certain embodiments of the invention, the respective magnetic polarities of the first structural member are disposed in alternating fashion along the first longitudinal axis.

Similarly, the second structural member has a second plurality of magnets or magnetic regions, where the second plurality of magnets or magnetic regions have respective magnetic polarities and respective magnetic axes disposed generally transverse to the second longitudinal axis. In certain embodiments of the invention, the respective magnetic polarities of the second structural member are disposed in alternating fashion along the second longitudinal axis.

The actuator mechanism includes a body and a third structural member. The third structural member is coupled to the body and to the first structural member so as, when under an actuating force, to urge the first structural member from a first spatial position into a second spatial position whereby the respective polarities of the first and second pluralities of magnets transition from respective states of mutual attraction to mutual opposition.

In some embodiments, a third structural member is coupled to the body of the actuator, and to the first structural member, so as to translate the first structural member from the first spatial position into the second spatial position in a direction generally parallel to the first longitudinal axis.

In some embodiments, the third structural member is coupled to the body of the actuator and to the first structural member so as to rotate the first structural member from a first spatial position into a second spatial position in a generally rotational motion around the first longitudinal axis.

In certain embodiments the first plurality of magnets includes a plurality of discrete magnets disposed within a discrete structural support member. In other embodiments, the first plurality of magnets includes a plurality of magnetized regions magnetized within an integral structural support member. In certain embodiments, the magnetized regions are formed (i.e., magnetized into a bulk material) after preparation of the structural support member. Certain embodiments of the invention include combinations of the foregoing.

In certain embodiments of the invention, the first plurality of magnets includes a plurality of discrete magnets coupled to one another in order to form the first structural member. That is, the bodies of multiple magnetic elements form a structural part of the structural member. In certain further embodiments of the invention, certain separators are disposed respectively between respective pairs of the plurality of discrete magnets or magnetic elements. In certain exemplary embodiments of the invention, certain of the plurality of separators include at least one elastomeric polymer material.

In certain embodiments prepared according to principles of the invention, at least one of the plurality of separators includes at least one molded-in-place elastomeric polymer material. Thus, elastomeric separator precursor material is disposed between the magnetic elements and cured, by thermal (e.g., cooling) or chemical reaction, to form the desired elastomeric material.

There are also embodiments of the invention in which at least one of the plurality of separators includes a universal joint. Moreover, in certain embodiments of the invention, at least one of the plurality of separators includes a generally helical coupling. In still other embodiments of the invention, at least one of the plurality of separators comprises an orienting ball joint. In such inventive embodiments, there will be at least one embodiment in which at least one of the plurality of separators includes an orienting flange.

In some embodiments of the invention, the plurality of separators will include any combination including optionally one or more separators including an elastomeric polymer material, one or more separators including a molded-in-place elastomeric polymer material, one or more separators including a universal joint, one or more separators including a generally helical coupling, one or more separators including an orienting ball joint, and one or more separator including an orienting flange.

There will also be embodiments of the invention where the actuator mechanism includes an input pedal and an input shaft, and the input shaft is operatively coupled between the input pedal and the third structural member. In such an embodiment, an external force applied to a surface region of the input pedal is coupled through the input shaft to the third structural member so as to apply the actuating force to the third structural member. In certain embodiments of the invention, the input shaft will include a flexible input shaft portion. In certain embodiments of the invention, the input shaft will operate in tension.

Additional embodiments of the invention will include an embodiment wherein the third structural member includes a linear link. Also included are certain embodiments of the invention in which the third structural member includes a pivotal link.

In another embodiment of the invention, the third structural member includes a pinion gear. The pinion gear operates to shift a spatial location of at least one of the first two structural members. Also, certain embodiments of the invention will include a closure where the third structural member includes a bell crank. Of course, combinations of any of the foregoing are intended to be within the scope of the present disclosure.

In certain aspects, the invention also includes a method of operating a magnetic closure. The method includes providing a first plurality of permanent magnets of alternating polarity, where the first plurality of permanent magnets is substantially coupled to a first portion of a material disposed adjacent a first side of an aperture. The method also includes providing a second plurality of permanent magnets of alternating polarity, where the second plurality of permanent magnets is substantially coupled to a second portion of the material disposed adjacent a second side of the aperture. Disposing the first plurality of magnets in attractive relationship to the second plurality of magnets respectively causes the magnets to urge the first portion of the material towards the second portion of the material, and thereby urges the material around the aperture to be displaced and close the aperture.

Displacing at least one of the first and second pluralities of permanent magnets with respect to the other plurality of permanent magnets serves, conversely, to place the first and second pluralities of magnets in opposing relationship to one another. Accordingly, the magnets 10 thereby to urge the first portion of the material away from the second portion of the material, and thereby to open the aperture.

It will be appreciated by one of skill in the art that the material in which the aperture is found may include a woven textile material, a felted textile material, a natural textile material, a synthetic textile material, a natural or synthetic polymer sheet material, a leather material or any other substrate that the present disclosure will suggest as an application of the present closure device to a user of skill in the art.

Moreover, the user of skill in the art will appreciate that any and all combinations of the foregoing and of other substrates are intended to fall within the present disclosure, and that the uses of such substrates will include, for example, garments, footwear, room dividers, refrigerator closures and other more or less sealed containers, vehicular applications, and any and all of a wide variety of applications that will become apparent over time.

The user of skill in the art will appreciate that the method will include, in certain embodiments, spatially displacing at least one of the first and second pluralities of magnets with that displacement includes translating at least one of the first and second pluralities of magnets along a line or line segment.

In still other embodiments of the invention, the method will include the spatially displacing at least one of the first and second pluralities of magnets by translating at least one of the first and second pluralities of magnets along a curve.

In still further embodiments of the method of the invention, the spatially displacing at least one of the first and second pluralities of magnets will include rotating at least one of the first and second pluralities of magnets about a longitudinal axis of the respective plurality of magnets. In still further embodiments of the method of the invention, the spatially displacing at least one of the first and second pluralities of magnets will include rotating at least one of the first and second pluralities of magnets about a longitudinal axis of the other plurality of magnets.

In yet another embodiment, the invention includes closure device having a first structural member with a first longitudinal axis, a second structural member with a second longitudinal axis, and an actuator mechanism. The actuator mechanism is coupled to respective first ends of the first and second structural members.

In an additional embodiment, the first structural member has a first plurality of magnets, and the first plurality of magnets have respective magnetic polarities and respective magnetic axes disposed generally transverse to the first longitudinal axis. In certain embodiments, the respective magnetic polarities are disposed in alternating fashion along the first longitudinal axis.

Similarly, the second structural member has a second plurality of magnets. The second plurality of magnets have respective magnetic polarities and respective magnetic axes disposed generally transverse to the second longitudinal axis. The respective magnetic polarities are disposed in alternating fashion along the second longitudinal axis.

The actuator mechanism includes a body and a third structural member, where the third structural member is coupled to the body and to the first structural member so as, when under an actuating force, to urge the first structural member from a first spatial position into a second spatial position. This change of position causes the respective polarities of the first and second pluralities of magnets to transition from respective states of mutual attraction to mutual opposition. In certain of these embodiments, the first and second longitudinal axes define a plane therebetween, and at least one of the first structural member and the second structural member includes at least one flexible element. This flexible element allows the first and/or second flexible member to flex preferentially in a direction of the plane.

In certain embodiments of the invention, the flexible element will include one or more living hinges. In certain moments of the invention, the flexible element will include a slot feature of the respective structural member. In certain embodiments of the invention, the slot feature is disposed between two or more adjacent magnets of the respective plurality of magnets.

In certain embodiments of the invention the slot feature of the at least one flexible element includes a generally triangular slot feature. In certain embodiments, the at least one flexible element includes an elliptical slot feature.

In still other embodiments of the invention, the at least one flexible element includes a spring member of the first structural member. The spring member is disposed between adjacent magnets of the first and second pluralities of magnets. In certain of these embodiments, the spring includes a helical spring element. In other embodiments the spring member includes a generally planar spring element. In still other embodiments, the spring member includes an elastomeric polymer portion.

In light of the foregoing, one of skill in the art will appreciate that a substrate can include an aperture that can be opened and closed by a closure device. The closure device will, in certain embodiments, include a first structural member having a first array of regions of alternating magnetic polarity. The closure device will also include a second structural member that includes a second array of regions of alternating magnetic polarity. These components will be arranged so that the closure device is adapted to open and close the aperture.

To open and close the aperture, the regions of alternating magnetic polarity of the first and second array are shiftable with respect to one another into a magnetically attractive configuration whereby the aperture is forced closed; and so that to open the aperture the first and second array are shiftable with respect to one another into a magnetically repulsive configuration whereby the aperture is forced open.

In certain embodiments, the closure will include an actuator, wherein the actuator permits opening of the aperture in the substrate without contact by a user with the structural members of the closure device. In certain moments of the invention, the two structural members will be maintained in proximity to one another at one end of the closure device. When the closure device begins a transition from open to close mode, the structural members are drawn successively towards one another during a transient phase, such that closure proceeds from one end of the closure device towards the other in a "zipping" fashion.

It will be appreciated by one of skill in the art that in various embodiments, the spatial shift of the magnetic apparatus is achieved by either a linear displacement of one or more of the structural members, or a rotary displacement of one or more of the structural members, or a combination of such motions.

It will be also appreciated by one of skill in the art that in certain embodiments, the magnetic fields determining magnetic polarity are the result of a permanent magnet. In other embodiments of the invention, the magnetic fields determining magnetic polarity will be the result of electromagnet.

The figures and text below are provided to enable any person skilled in the art to make and use the disclosed inventions and sets forth the best modes presently contemplated by the inventor for carrying out his inventions. In the following description, for purposes of explanation, numerous specific details are set forth in order to provide a thorough understanding of the present invention. It will be apparent, however, to one skilled in the art that the present invention may be practiced without these specific details. In other instances, certain structures and devices are shown in block diagram form in order to avoid unnecessarily obscuring the substance disclosed. These and other advantages and features of the invention will be more readily understood in relation to the following detailed description of the invention, which is provided in conjunction with the accompanying drawings.

It should be particularly noted that the magnetic elements and/or regions need not be in a particular linear arrangement, but may be a two-dimensional array or other arrangement of elements. Thus, for example, there may be a first row of magnets disposed along the length of a structural member, with a second row disposed above the first row, either aligned with the row of magnets below, or offset from the row of magnets below.

It should also be noted that, while the various figures show respective aspects of the invention, no one figure is intended to show the entire invention. Rather, the figures together illustrate the invention in its various aspects and principles. As such, it should not be presumed that any particular figure is exclusively related to a discrete aspect or species of the invention. To the contrary, one of skill in the art would appreciate that the figures taken together reflect various embodiments exemplifying the invention.

Correspondingly, references throughout the specification to "one embodiment" or "an embodiment" means that a particular feature, structure, or characteristic described in connection with the embodiment is included in at least one embodiment of the present invention. Thus, the appearance of the phrases "in one embodiment" or "in an embodiment" in various places throughout the specification are not necessarily all referring to the same embodiment. Furthermore, the particular features, structures, or characteristics may be combined in any suitable manner in one or more embodiments.

DETAILED DESCRIPTION

The following description is provided to enable any person skilled in the art to make and use the disclosed inventions and sets forth the best modes presently contemplated by the inventor for carrying out his invention. In the following description, for purposes of explanation, numerous specific details are set forth in order to provide a thorough understanding of the present invention. It will be apparent, however, to one skilled in the art that the present invention may be practiced without these specific details. In other instances, well-known structures and devices are shown in block diagram form in order to avoid unnecessarily obscuring the substance disclosed.

Figure 1A:
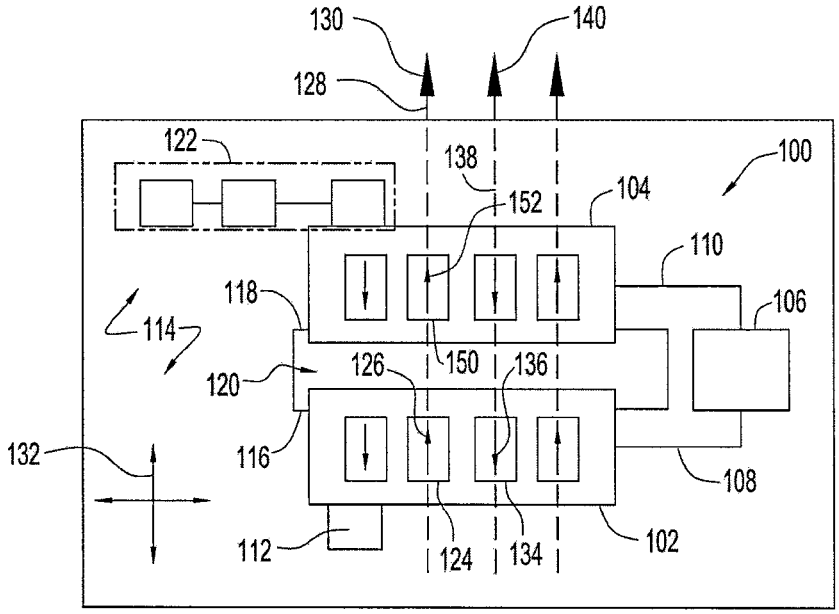
FIG. 1A shows, in schematic block diagram form, certain exemplary aspects of a closure prepared according to principles of the invention in a first operational state.

FIG. 1A shows, in schematic block diagram form, a controllable closure 100 prepared according to principles of the invention. In the illustrated embodiment, the closure includes a first magnet portion 102 and a second magnet portion 104. An actuator 106 is operatively coupled 108 to the first magnet portion 102. The actuator 106 is also operatively coupled 110 to the second magnet portion 104.

As exemplified in the illustrated embodiment, the first magnet portion 102 is mechanically coupled through a first coupling portion 112 to a substrate 114. The substrate 114 includes a first edge region 116 and a second edge region 118; the edge regions 116, 118 defining an aperture 120 of the substrate 114.

The second magnet portion 104 is mechanically coupled to the substrate 114 through a second coupling portion 122. As will be further discussed below, in certain embodiments, the second coupling portion 122 includes a relaxation apparatus disposed between the second magnet portion 104 and the substrate 114.

The first magnet portion 102 includes a first magnetic region 124 with a first permanent magnetic polarity 126 disposed along a first magnetic axis 128 and oriented substantially parallel to a first spatial direction 130 relative to a frame of reference 132 of the closure 100. The first magnet portion 102 also includes a second magnetic region 134 with a second permanent magnetic polarity 136 disposed along a second magnetic axis 138 and oriented substantially antiparallel to a second spatial direction 140 relative to the frame of reference 132 of the closure 100. Accordingly, in the illustrated embodiment of the invention, the first magnetic axis 128 is disposed substantially parallel to the second magnetic axis 138, and the first spatial direction 130 is substantially parallel to the second spatial direction 140.

As shown in FIG. 1A, the second magnet portion 104 includes a third magnetic region 150 with a third permanent magnetic polarity 152 disposed along the first magnetic axis 128 and oriented substantially parallel to the first spatial direction 130 relative to the frame of reference 132 of the closure 100.

It will be apparent to one of skill in the art that, to the extent that the magnetic region 124 is disposed generally in proximity to magnetic region 150 (i.e., within a distance such that their respective magnetic fields interact with nontrivial forces), and bearing in mind that their respective polarities 126 and 152 are respectively generally coaxial with magnetic axis 128 and mutually aligned in direction 130, magnetic regions 124 and 150 will experience a mutual attraction to one another.

In light of the respective mechanical couplings of magnetic portions 102 and 104 to substrate 114 through coupling portions 112 and 122 respectively, the above-mentioned mutual attraction will tend to cause magnetic portions 102 and 104 to urge edges 116 and 118 respectively of substrate 114 towards one another, and thereby to urge (and desirably produce) closure of aperture 120. Accordingly, FIG. 1A shows the closure 100 disposed in a first operational state designated as a "closed configuration" of the closure 100.

Figure 1B:
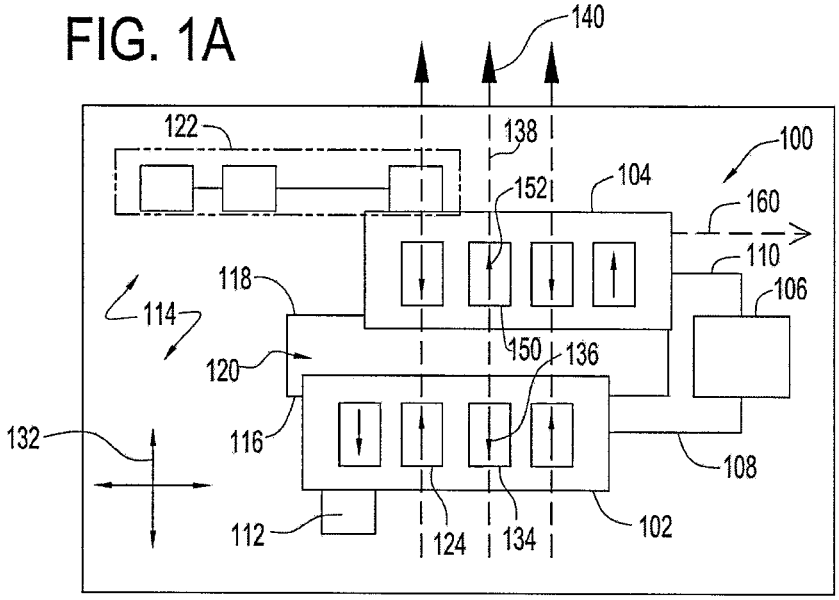
FIG. 1B shows, in schematic block diagram form, certain exemplary aspects of a closure prepared according to principles of the invention in a second operational state.

In contrast, FIG. 1B shows the closure 100 disposed in a second operational state designated as an "open configuration" of the closure 100. Accordingly, FIG. 1B shows, in schematic block diagram form, the controllable closure 100 including the first magnet portion 102 and the second magnet portion 104. The actuator 106 is operatively coupled 108 to the first magnet portion 102. The actuator 106 is also operatively coupled 110 to the second magnet portion 104.

As exemplified in the illustrated embodiment, the actuator 106 has acted on the second magnet portion 104 through the coupling 110 to urge the magnet portion 104 through a translation in a direction 160 with respect to the frame of reference 132 of the closure 100. At the same time, passive and/or active reactive forces transmitted from actuator 106 through coupling 108 to first magnet portion 102 maintain magnet portion 102 static with respect to frame of reference 132, or urged in in a direction opposite to direction 160.

The translation serves to realign the magnetic region 150 of magnet portion 104 with respect to magnetic regions 124 and 134 of magnet portion 102. Consequently, in the second operative state (i.e., open configuration) magnetic region 150 is disposed in proximity to magnetic region 134. In this configuration, the third permanent magnetic polarity 152 of magnetic region 150 is disposed along the second magnetic axis 138 and oriented substantially parallel to the second spatial direction 140 relative to the frame of reference 132 of the closure 100.

It will be apparent to one of skill in the art that, to the extent that the magnetic region 134 is disposed generally in proximity to magnetic region 150 (i.e., within a distance such that their respective magnetic fields interact with nontrivial forces), and bearing in mind that their respective polarities 136 and 152 are respectively generally coaxial with magnetic axis 138 and mutually opposed with respect to direction 140, magnetic regions 134 and 150 will experience a mutual repulsion with respect to one another.

In light of the respective mechanical couplings of magnetic portions 102 and 104 to substrate 114 through coupling portions 112 and 122 respectively the above-mentioned mutual repulsion will tend to cause magnetic portions 102 and 104 to urge edges 116 and 118 respectively of substrate 114 away from one another, and thereby to urge (and desirably produce) opening of aperture 120. Accordingly, FIG. 1B shows the closure 100 disposed in the second operational state designated as the "open configuration" of the closure 100.

It will be appreciated by one of skill in the art that, while the actuator 106 of closure 100 is exemplified as effecting a linear translation between the first magnetic portion 102 and second magnetic portion 104 respectively, this is only one of a wide variety of realignments and/or rearrangements of magnetic configuration that fall within the scope of the present invention. It will be appreciated, for example, that a rotary actuation of respective magnetic regions will likewise produce an operational state transition from a first open configuration to a second closed configuration and back again. Likewise, combinations of rotation and translation, as well as the rearrangement of a wide variety of magnetic shunt arrangements will produce the desired transition of the closure 100 between open and closed configurations. It should be understood that all of these various reconfigurations are intended to fall within the scope of the present disclosure, and but for practical limitations of time would be described here in full. Nevertheless, in light of the present description, and with a minimum of experimentation, one of skill in the art will arrive at any and all of these various inventive configurations, and would thus deem this a comprehensive disclosure.

It will also be of significance to one of skill in the art that actuator 106 will, in certain embodiments, include a first portion adapted to be disposed relatively proximate to the magnet portion 102 and 104, and a second portion adapted to be disposed relatively distal to the magnet portion 102 and 104. Consequently, in certain desirable embodiments, remote actuation of the closure 100, so as to produce a transition between the first operative state and the second operative state will be readily achieved. Such remote operation will be of great benefit in many circumstances including where the closure 100 is employed in the service of those with a limited range of motion.

It will also be appreciated by one of skill in the art that the closure described herewith is employed and will be used in a wide variety of configurations and applications including, for example only and without limitation, to effect a desirable control of apertures of garments, shoes and boots, airflow curtains, dampers, dust curtains, light curtains, sunshades, spacesuits, airlocks, doors, refrigerators and other storage lockers, luggage, and anywhere one might apply any alternative closure mechanism such as, for example and without limitation, a hook and loop fastener, a zipper fastener, an adhesive fastener, buttons or shoe hooks, or any other apparatus or mechanism known or that becomes known in the art. That said, the benefits of the present apparatus over those previously in existence will become apparent in light of the foregoing, and of the further disclosure presented herewith.

In light of the foregoing discussion, one of skill in the art will readily understand that a wide variety of different mechanical arrangements and structures will be beneficially prepared for respective applications and embodiments of the invention. Moreover, considerations of robustness, durability, manufacturability and ease of application will motivate a still further plethora of embodiments. Accordingly, the following embodiments are presented merely as exemplary of a wide variety of implementations that are anticipated in light of the scope and import of the present invention.

Figure 2B:
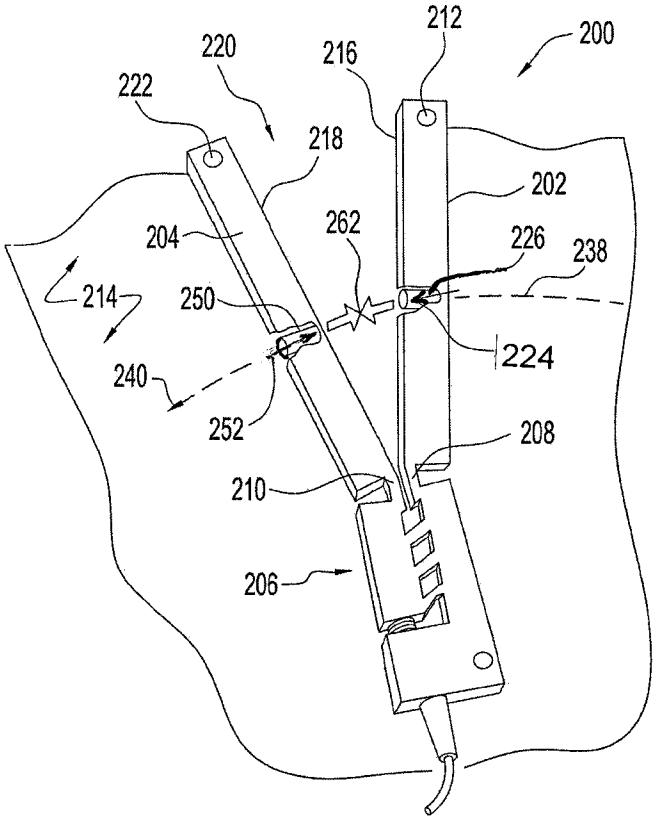
FIG. 2B shows, in cutaway schematic perspective view, certain exemplary aspects of a closure prepared according to principles of the invention in a second operational state.
Figure 2A:
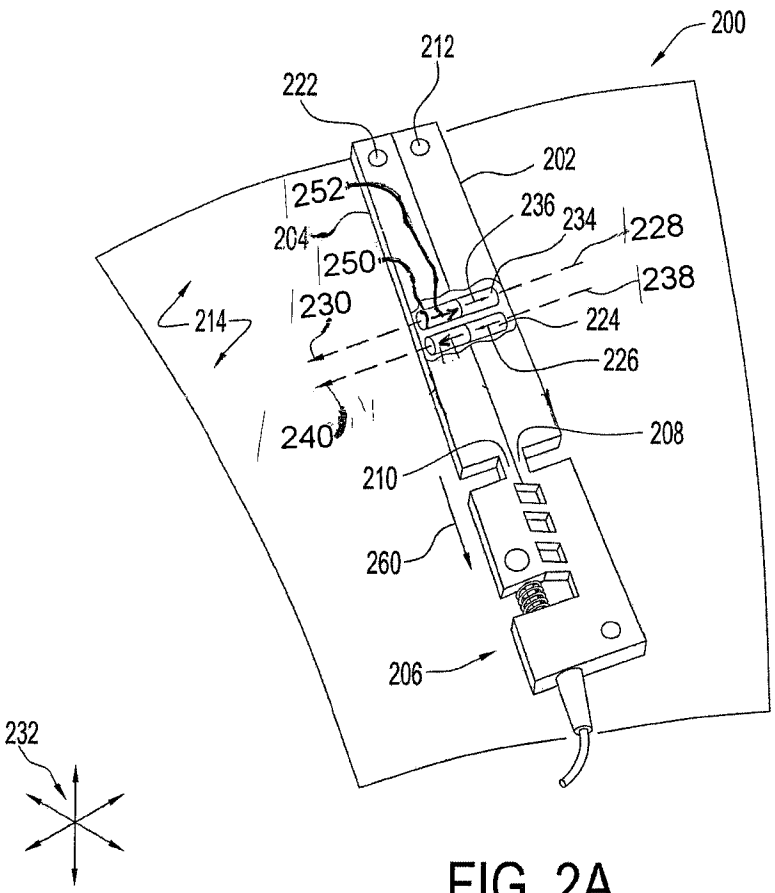
FIG. 2A shows, in cutaway schematic perspective view, certain exemplary aspects of a closure prepared according to principles of the invention in a first operational state.

FIGS. 2A and 2B show, in cutaway schematic perspective view, exemplary aspects of one controllable closure 200 prepared according to principles of the invention in closed and open configurations respectively.

Referring to FIG. 2A, first closure 200 includes a first magnet portion 202 and a second magnet portion 204. An actuator 206 is operatively coupled through a first coupling member 208 to the first magnet portion 202. The actuator 206 is also operatively coupled through a second coupling member 210 to the second magnet portion 204.

As exemplified in the illustrated embodiment, the first magnet portion 202 is mechanically coupled through a first coupling portion 212 to a substrate 214. Referring now to FIG. 2B the substrate 214 includes a first edge region 216 and a second edge region 218; the edge regions 216, 218 defining an aperture 220 of the substrate 214.

Referring again to FIG. 2A The second magnet portion 204 is mechanically coupled to the substrate 214 through a second coupling portion 222. As will be further discussed below, in certain embodiments, the second coupling portion 222 includes a relaxation apparatus disposed between the second magnet portion 204 and the substrate 214. It will be appreciated by one of skill in the art that the second magnet portion 204 will typically move in relation to the substrate during operation of the closure. Where the substrate is sufficiently flexible, the second magnet portion will be directly coupled to the substrate. In other circumstances, it will be appropriate to apply a relaxation apparatus between the second magnet portion and the substrate to accommodate the relative motion therebetween. One of skill in the art will readily understand that this relaxation apparatus will include, for example, a spring, a linear slide, an elastomeric element, an arrangement of hinged diagonal links, or any other appropriate extending and retracting coupling.

The first magnet portion 202 includes a first magnetic element 224 with a first permanent magnetic polarity 226 disposed along a first magnetic axis 238 and oriented substantially parallel to a first spatial direction 240 relative to a frame of reference 232 of the closure 200. The first magnet portion 202 also includes a second magnetic element 234 with a second permanent magnetic polarity 236 disposed along a second magnetic axis 228 and oriented substantially antiparallel to a second spatial direction 230 relative to the frame of reference 232 of the closure 200. Accordingly, in the illustrated embodiment of the invention, the first magnetic axis 238 is disposed substantially parallel to the second magnetic axis 228, and the first spatial direction 240 is substantially parallel to the second spatial direction 230.

As shown in FIG. 2A, the second magnet portion 204 includes a third magnetic element 250 with a third permanent magnetic polarity 252 disposed along the second magnetic axis 228 and oriented substantially antiparallel to the second spatial direction 230 relative to the frame of reference 232 of the closure 200.

It will be apparent to one of skill in the art that, to the extent that the magnetic element 234 is disposed generally in proximity to magnetic element 250 (i.e., within a distance such that their respective magnetic fields interact with nontrivial forces), and bearing in mind that their respective polarities 236 and 252 are respectively generally coaxial with magnetic axis 228 and mutually aligned antiparallel (opposite) to direction 230, magnetic elements 234 and 250 will experience a mutual attraction to one another.

In light of the respective mechanical couplings of magnetic portions 202 and 204 to substrate 214 through coupling portions 212 and 222 respectively, the above-mentioned mutual attraction will tend to cause magnetic portions 202 and 204 to urge edges 216 and 218 respectively of substrate 214 towards one another, and thereby to urge (and desirably produce) closure of aperture 220. Accordingly, FIG. 2A shows the closure 200 disposed in a first operational state designated as the "closed configuration" of the closure 200.

In contrast, FIG. 2B shows the closure 200 disposed in the second operational state designated as the "open configuration" of the closure 200. Accordingly, FIG. 2B shows the controllable closure 200 including the first magnet portion 202 and the second magnet portion 204, and the actuator 206.

As compared with the first closed configuration state of the closure 200 (as shown in FIG. 2A), in the second open configuration state of the closure 200 (as shown in FIG. 2B) the actuator 206 has been operated to urge (i.e., draw), the second coupling member 210 towards the actuator 206 in direction 260, while maintaining first coupling member 208 substantially immobile with respect to the actuator 206. Accordingly, second magnet portion 204 has moved through a translation generally in a spatial direction 260 with respect to frame of reference 232 of the closure 200.

At the same time, passive and/or active reactive forces transmitted from actuator 206 through first coupling member 208 to first magnet portion 202 maintain magnet portion 202 static with respect to frame of reference 232, or urged in in a direction opposite to direction 260.

The translation in direction 260 serves to realign the magnetic element 250 of second magnet portion 204 with respect to magnetic elements 224 and 234 of first magnet portion 202. Consequently, in the second operative state (i.e., the open configuration) magnetic element 250 is disposed in proximity to magnetic element 224. In this configuration, the third permanent magnetic polarity 252 of magnetic element 250 is disposed along the first magnetic axis 238 and oriented substantially antiparallel to the first spatial direction 240 relative to the frame of reference 232 of the closure 200.

It will be apparent to one of skill in the art that, to the extent that the magnetic element 224 is disposed generally in proximity to magnetic element 250 (i.e., within a distance such that their respective magnetic fields interact with nontrivial forces), and bearing in mind that their respective polarities 226 and 252 are respectively generally coaxial with magnetic axis 238 and disposed mutually opposed with respect to direction 240, magnetic elements 224 and 250 will experience a mutual repulsion 262 with respect to one another.

In light of the respective mechanical couplings of magnetic portions 202 and 204 to substrate 214 through coupling portions 212 and 222 respectively, the above-mentioned mutual repulsion 262 will tend to cause magnetic portions 202 and 204 to urge edges 216 and 218 respectively of substrate 214 away from one another, and thereby urge (and, desirably, effect) opening of aperture 220. Accordingly, FIG. 2B shows the closure 200 disposed in the second operational state designated as the "open configuration" of the closure 200.

To the extent that the substrate 214 is implemented as a portion of a garment, a wearer of the garment can effect opening and closing of aperture 220 by operation of the actuator portion 206 so as to facilitate donning and/or removing the garment.

It will be appreciated by one of skill in the art that the illustrated translation in direction 260 of magnetic portion 204 by action of the actuator 206 is only one of many ways in which the magnetic configurations of magnetic portions 202 and 204 can be rearranged and/or reoriented to cause a transition in the attractive state of the magnetic portions 202, 204 with respect to one another. In other embodiments, actions such as rotation of the magnetic elements about a longitudinal axis of the respective magnetic portion, rotation of the magnetic elements about a respective axis transverse to that longitudinal axis, translation of magnetic shunt elements, and/or any combination of the same and/or other motions will be applied to beneficial effect.

Figure 3B:
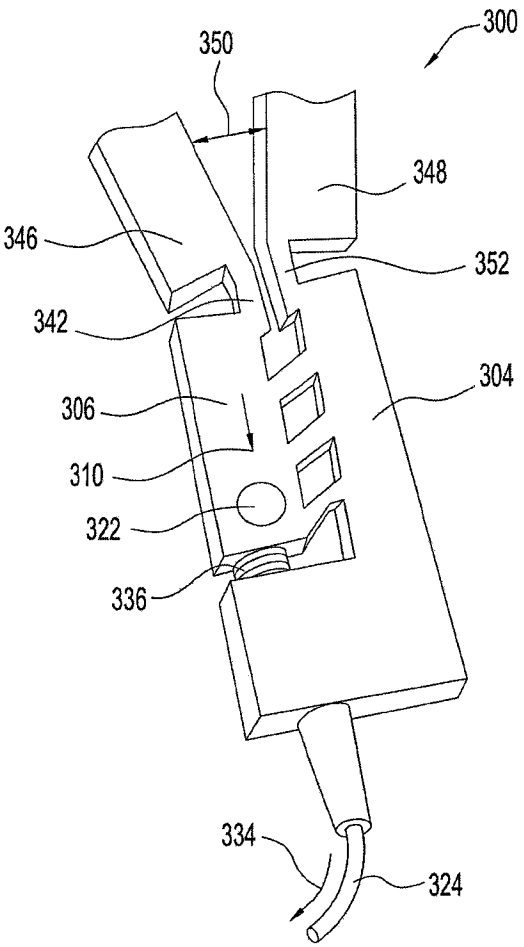
FIG. 3B shows, in schematic perspective view, certain aspects of an exemplary actuator for a closure prepared according to principles of the invention in a second operational state.
Figure 3A:
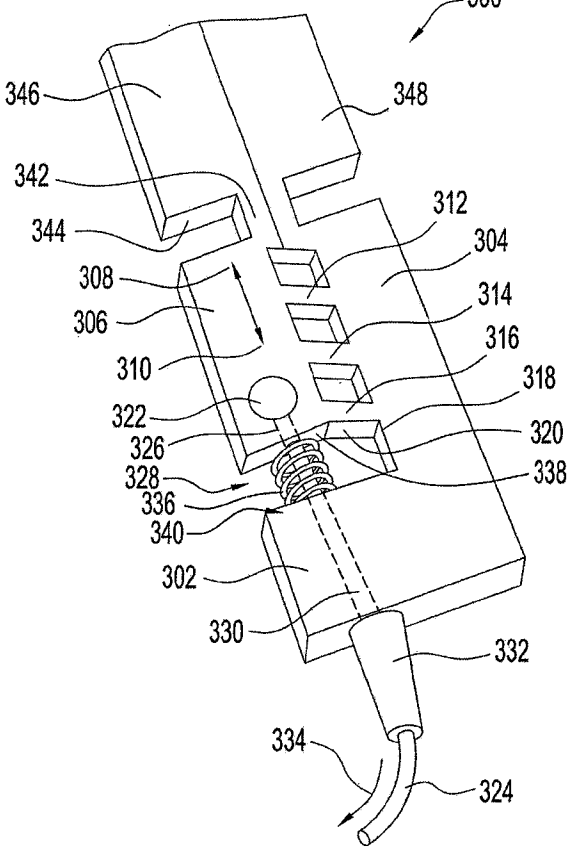
FIG. 3A shows, in schematic perspective view, certain aspects of an exemplary actuator for a closure prepared according to principles of the invention in a first operational state.

FIG. 3A shows, in additional detail, certain aspects of an actuator 300 similar to actuator 206 of closure 200. It will be appreciated by one of skill in the art, that actuator 300 is merely exemplary of a wide variety of actuators to produce respective desirable rearrangements and/or reconfigurations of the magnetic elements of a closure such as closure 200. As illustrated, and as will be further explained below, actuator 300 is shown in a first closed configuration state in FIG. 3A.

Actuator 300 includes a base portion 302 and a static member 304. The static member 304 is substantially fixedly coupled to the base portion 302. In the illustrated embodiment, static member 304 is formed as an integral unit with the base portion 302. In alternative embodiments of the invention, static member 304 and base portion 302 are prepared discretely and thereafter coupled together.

Actuator 300 also includes a dynamic member 306. Dynamic member 306 is configured and adapted to move backwards and forwards and directions 308, 310 in relation to static member 304 during operation of the actuator 300. As shown, one or more link members, e.g., 312, 314, 316 are disposed between the static member 304 and the dynamic member 306.

Each link member e.g., link 316 is coupled at a first end through a first live hinge 318 to static member 304 and through a second live hinge 320 to dynamic member 306.

In the illustrated embodiment, an anchor element 322 is substantially fixedly coupled to the dynamic member 306. A longitudinal tensile (and here flexible) member 324, such as, for example, a miniature steel cable is coupled at a distal end thereof to the anchor member 322. The tensile member 324 is disposed through a first bore 326 of the dynamic member 306. The tensile member 324 traverses a gap 328 and passes through a second bore 330 of the base portion 302. Thereafter, in certain embodiments the tensile member 324 passes through, for example, a channel or flexible tube 332. A proximal end of the tensile member 324 and, in certain embodiments, the flexible tube 332, is coupled to a further remote actuator (not shown). The remote actuator serves and is adapted to apply and release a tensile force 334 on the tensile member. Tensile force 334 serves to draw anchor 322, and consequently dynamic member 306, in direction 310.

In certain desirable embodiments, the remote actuator is a bistable mechanical device. A first mechanical operator input to the remote actuator causes it to transition from a first state in which the cable is relatively extended to a second state in which the cable is relatively retracted. A second mechanical operator input to the remote actuator causes it to transition from the second state in which the cable is relatively retracted back to the first state in which the cable is relatively extended. In the absence of a mechanical operator input, the remote actuator remains in the current state i.e., the remote actuator is bistable.

The illustrated actuator 300 includes an optional return spring 336 disposed between a proximal surface region 338 of the dynamic member 306 and a distal surface region 340 of the base portion 302. The return spring 336 serves to urge surface region 338 away from surface region 340, and consequently serves to urge dynamic member 306 in direction 308. It will be appreciated that, in certain embodiments, the return spring 336 will not be present. Rather the design of the overall apparatus, including the links and live hinges as well as the placement of the magnetic elements will provide sufficient restoring/return forces.

At the extreme of this motion in direction 308, the actuator is in a first state (the first state corresponding to a closed configuration of a closure including the actuator). In this closed configuration, a coupling 342 disposed between the dynamic member 306 and a distal end 344 of a first magnetic portion 346 serves to maintain the first magnetic portion 346 in a first relatively distal (i.e., in direction 308) position with respect to a second magnetic portion 348.

In contrast, FIG. 3B shows the actuator 300 in a second state referred to as an open configuration. In the open configuration of FIG. 3B a tensile force 334 applied to tensile member 324 has drawn anchor 322, and consequently dynamic member 306 in direction 310, and into a relatively proximal location with respect to static member 304. This motion has elastically compressed spring 336. The motion in direction 310 also has drawn coupling 342, and consequently magnetic portion 346 into a proximal location with respect to magnetic portion 348.

One of skill in the art will appreciate that, in many embodiments of the invention, magnetic portion 346 and 348 will include magnetic assemblies of structural members and permanent magnets. The indicated motion of dynamic member 306 in direction 310 will serve to realign and/or reposition respective magnets of the first and second magnetic portions 346 and 348, such that the respective magnets transition from an attractive state (corresponding to attraction between first and second magnetic portion 346 and 348) to a repulsive state (corresponding to repulsion between first and second magnetic portion 346 and 348.

In consequence, and as illustrated in FIG. 3B a closure including actuator 300 will be disposed in an open configuration with magnetic portions 346 and 348 diverging 350 from one another along their respective lengths.

The practitioner of skill in the art will observe that, in FIG. 3B couplings 342 and 352 have flexed and/or deflected to permit and accommodate this divergence of magnetic portions 346 and 348. Accordingly, in certain embodiments of the invention, the couplings 342, 352 will serve as and/or include a hinge element such as, for example a live hinge. In some embodiments of the invention, additional portions, and/or the entire lengths of magnetic portion 346 and 348 are flexible and thus further allow the above indicated and desirable divergence of those members. Certain embodiments of the invention will include both flexible couplings and flexible magnetic portions, as well as additional hinges and other features beneficial to the opening and closing of the closure according to principles of the invention.

In consideration of the foregoing description of FIGS. 3A and 3B, one of skill in the art will readily appreciate that actuator 300 includes a compliant link mechanism. A compliant link mechanism includes compliant, i.e. flexible hinges, often referred to as "live" or "living" hinges. Compliant link mechanisms generally have advantages including ease of manufacturing, durability and minimal backlash. In particular, compliant link mechanisms, and especially those that include synthetic polymer materials such as, for example and without limitation, ultrahigh molecular weight polyethylene, are amenable to manufacturing by methods of injection molding, extrusion, machining, and other methods known in the art. It should be noted, however, that a wide variety of other approaches and elements will be appropriate for inclusion when preparing closures according to the present invention, and such other approaches will be readily available to one of skill in the art with a minimum of experimentation in light of the present disclosure.

Figure 4:
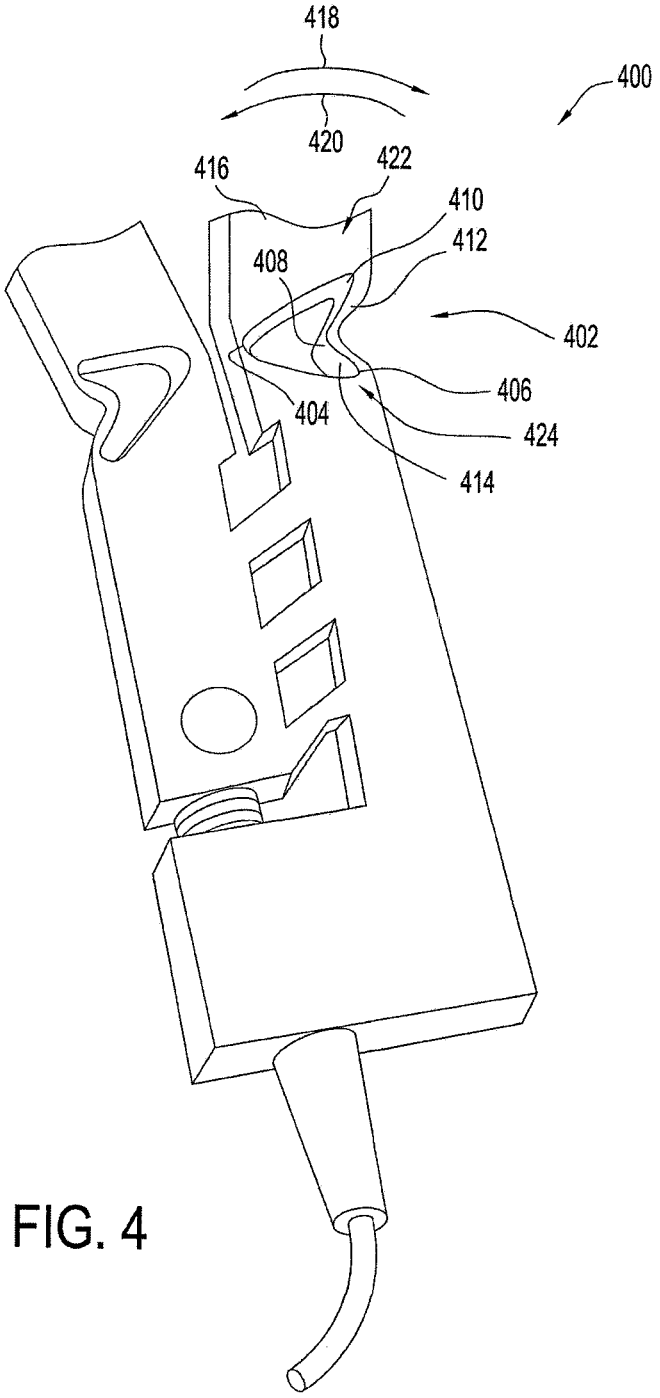
FIG. 4 shows, in schematic perspective view, certain further aspects of an exemplary actuator for a closure prepared according to principles of the invention in a first operational state.

FIG. 4 shows a further actuator 400 including a unidirectional constrained compliant hinge element 402, rather than the simple coupling e.g., 342, 352 of actuator 300. The compliant hinge element 402 includes a first compliant hinge 404, a second compliant hinge 406, a third compliant hinge 408, and a fourth compliant hinge 410. In the illustrated embodiment, a first substantially rigid link member 412 is disposed between compliant hinge 408 and compliant hinge 410. A second substantially rigid link member 414 is disposed between compliant hinge 406 and compliant hinge 408.

Upon inspection of FIG. 4, one of skill in the art will appreciate that the hinge element 402 will readily permit rotation of a magnetic portion 416 in a first direction 418, but will limit the extent of motion in direction 420 of the magnetic portion 416 to prevent overextension in direction 420.

One of skill in the art will also understand that, in certain embodiments of the invention, rather than substantially rigid links 412 and 414, a uniformly or variably flexible element will extend between locations 422 and 424.

Whether including compliant elements, or otherwise, one of skill in the art will appreciate that that a wide variety of materials will be beneficially employed in manufacturing particular examples of the closure of the present invention. Such materials will include, for example and without limitation, polyethylene, polypropylene, polybutylene, polystyrene, polyester, acrylic polymers, polyvinylchloride, polyamide, or polyetherimide like ULTEM.RTM.; a polymeric alloy such as Xenoy.RTM. resin, which is a composite of polycarbonate and polybutyleneterephthalate or Lexan.RTM. plastic, which is a copolymer of polycarbonate and isophthalate terephthalate resorcinol resin, liquid crystal polymers, such as an aromatic polyester or an aromatic polyester amide containing, as a constituent, at least one compound selected from the group consisting of an aromatic hydroxycarboxylic acid (such as hydroxybenzoate (rigid monomer), hydroxynaphthoate (flexible monomer), an aromatic hydroxyamine and an aromatic diamine.

In addition, any polymeric composite such as engineering prepregs or composites, which are polymers filled with pigments, carbon particles, silica, glass fibers, conductive particles such as metal particles or conductive polymers, or mixtures thereof may also be used. For example, a blend of polycarbonate and ABS (Acrylonitrile Butadiene Styrene) may be used. It should be understood that the foregoing examples are merely exemplary and not intended to be comprehensive.

Figure 5:
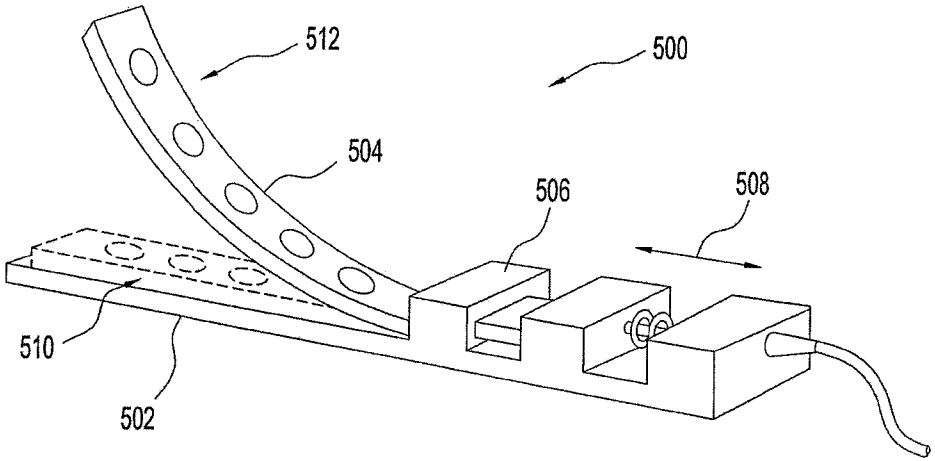
FIG. 5 shows, in schematic perspective view, certain further aspects of an exemplary actuator for a closure prepared according to principles of the invention in a first operational state.

In light of the disclosure provided herewith, the practitioner of ordinary skill in the art will immediately recognize that a closure according to principles of the invention will be prepared exhibiting a wide variety of alternative arrangements and configurations, any of which will effect rearrangement of the closure between a first closed configuration in which magnetic elements are attracted to one another and a second open configuration in which magnetic elements are not attracted and/or repelled from one another. Accordingly, FIG. 5 shows a closure 500 including a first magnetic assembly 502 and a second magnetic assembly 504. A portion of assembly 504 is disposed within a linear bearing feature 506 such that, by operation of an actuator, is drawn along a direction 508 from a first closed configuration 510 to a second open configuration 512.

Figure 6:
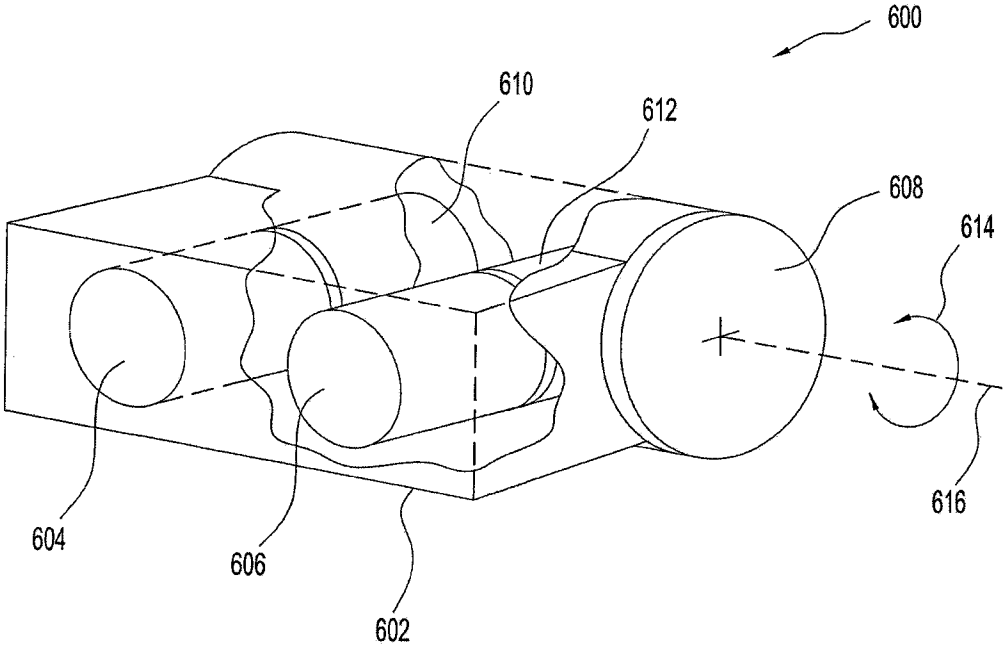
FIG. 6 shows, in cutaway schematic perspective view, certain further aspects of an exemplary actuator for a closure prepared according to principles of the invention in a first operational state.

FIG. 6 shows a further closure 600 including a first magnetic assembly 602 including one or more magnets, e.g., 604, 606 and a second magnetic assembly 608 including one or more further magnets, e.g., 610, 612. Upon inspection of FIG. 6 one of skill in the art will immediately understand that, by rotation 614 of the second magnetic assembly 608 about a longitudinal axis 616 the closure will be made to transition between a first closed configuration and a second open configuration. Accordingly, rather than placing one magnetic assembly in compression and another in tension, as with closures 200, 300 and 500, closure 600 places one magnetic assembly and torsion with respect to the other.

In an alternative embodiment, rotation 614 serves to place permanent magnets 610 and 612 in alignment with a C-shaped shunt (and/or a respective plurality of shunts), such that their magnetic fields are substantially contained within the shunts. In such a case, the second assembly 602 need not include permanent magnets, may simply include an un-magnetized material (such as, e.g., a ferromagnetic material). In the illustrated orientation, magnets 610 and 612 will attracted to the un-magnetized material, resulting in a closed configuration of the closure. In a rotated orientation, with the poles of the magnets 610, 612 will be aligned with their respective shunts, and thus will be substantially unattractive to the un-magnetized material.

In certain embodiments of the invention, a combination of the embodiments described above in relation to FIG. 6 will prove beneficial. In such an embodiment, strong opposing magnets, e.g., 610, 604 will be disposed at a distal end (in relation to the actuator) of the magnetic assembly 602, 608 to ensure closure (i.e., to provide the relatively high closing forces required because the system is asymmetrical where there are no further magnets above the distal end point). Below these magnets more proximal to the actuator, a portion 602 including unmagnetized material on one side and permanent magnets adapted to rotate into and out of alignment with C-shaped shunts provides closure for the intermediate distance. The use of un-magnetized material will, in certain embodiments, allow greater physical flexibility and variation of design according to the requirements of a particular circumstance.

Figure 7B:
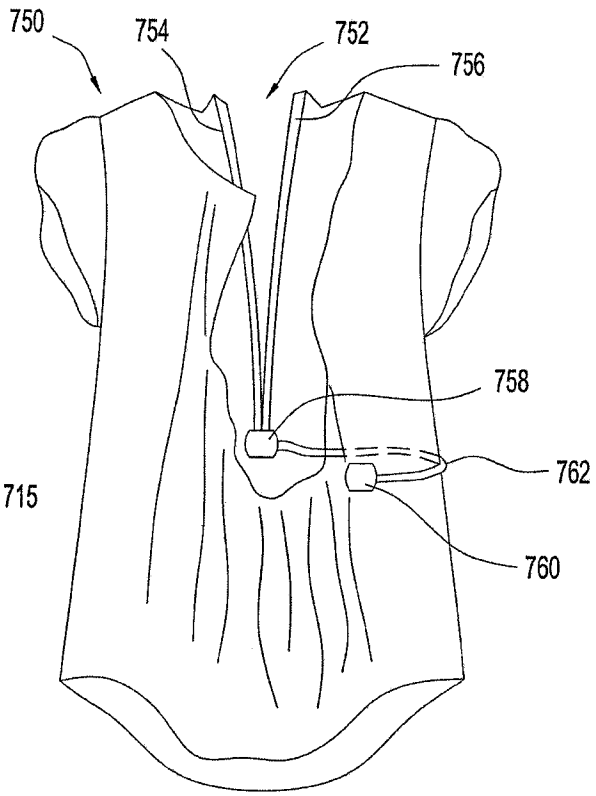
FIG. 7B shows, in cutaway schematic perspective view, certain aspects of a garment including a closure prepared according to principles of the invention.
Figure 7A:
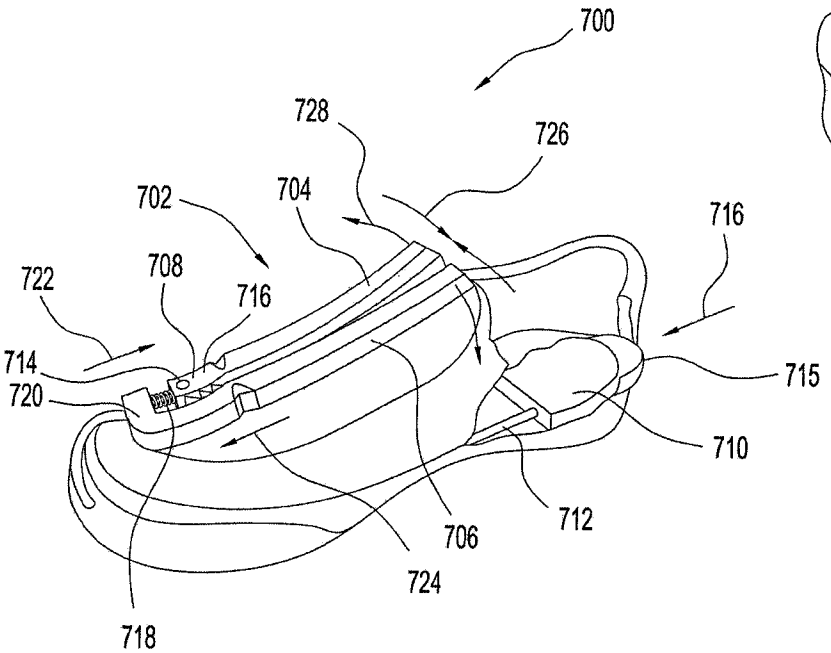
FIG. 7A shows, in cutaway schematic perspective view, certain aspects of a shoe including a closure prepared according to principles of the invention.

FIG. 7A shows, in cutaway schematic perspective view, a shoe 700 including a closure 702 prepared according to principles of the invention. The closure 702 includes first 704 and second 706 magnetic assemblies and an actuator 708, as well as a remote actuator 710. An operating cable 712 is disposed between the actuator 708 and the remote actuator 710. By depressing a button member 715 on the remote actuator 710 in direction 716, a person wearing the shoe is able to cycle the remote actuator 710 through a first extended state and a second contracted state.

A distal end of the operating cable 712 is coupled at an anchor 714 to a dynamic member 716 of the actuator 708. A return spring 718 of the actuator 708 urges the dynamic member 716 away from a base portion 720 of the actuator 708 such that, when the remote actuator 710 is in the first extended state, the operating cable 712 is relatively extended, and the dynamic member 716 of the actuator 708 is disposed relatively distal in direction 722. Alternately, when the remote actuator 710 is in the second retracted state, the operating cable 712 is relatively retracted, and the dynamic member 716 of the actuator 708 is disposed relatively proximal, in direction 724.

In light of the general description provided above, one of skill in the art will appreciate that in one of the extended or retracted state the first 704 and second 706 magnetic assemblies will be arranged and configured to be attracted 726 to one another. In the second of the extended or retracted state, the first 704 and second 706 magnetic assemblies will be arranged and configured to be repelled 728 from one another. Accordingly, by repetitively applying pressure in direction 716 to button member 715 of the remote actuator 710, the wearer of the shoe 700 will be able to control whether or not the closure is in its open configuration or in its closed configuration. Accordingly, the wearer of the shoe will be able to place the shoe either in a first configuration in which it is firmly secured to the wearer's foot and a second configuration in which it is readily put on or off.

FIG. 7B shows, in cutaway schematic perspective view, a blouse 750 including a closure 752 prepared according to principles of the invention. The closure 752 includes a first magnetic assembly 754, a second magnetic assembly 756 and an actuator 758, as well as a remote actuator 760. An operating cable 762 is disposed between the actuator 758 and the remote actuator 760. By depressing a button, pressing a lever, rotating a knob, or any other desirable operation applied to the remote actuator 760, a person wearing the blouse is able to cycle the remote actuator 760 through a first relaxed state and a second extended state, thereby producing at the closure 752 a first closed configuration and a second open configuration.

As a practitioner of ordinary skill in the art reviews the mechanics of the foregoing disclosure, it will become apparent that certain engineering considerations will offer the opportunity for improvements. In particular, it will be apparent that, especially in longer closure apparatus, the possibility of elastic and/or inelastic deformation of the magnetic assembly in tension, and/or the magnetic assembly in compression, may result in an undesirable desynchronization of the release of the closure (i.e., of a transition from attractive to repulsive magnetic configurations between individual magnets along the length of the magnetic assemblies respectively). These considerations will be addressed with appropriate engineering choices of materials, magnetic characteristics, and structural form.

Of course, one of skill in the art will appreciate that shunt-based alternative embodiments, including magnets on one or more sides of an aperture, will be applied in respective embodiments of the invention, where the reorientation of the magnets will involve any of a wide variety of translations, rotations and combinations thereof.

Accordingly, in certain embodiments of the invention, it will be desirable to configure the spacing and/or strength and/or physical characteristics of magnets and or magnetic regions according to the requirements of the balance of the mechanism, and of the intended operation of the apparatus as a whole.

In addition, in certain embodiments of the invention, additional (i.e., supplemental) magnets will be provided at various locations along the length of a magnetic assembly. For example, in certain embodiments of the invention it will be desirable to provide additional and/or stronger magnets at a terminal end of the magnetic assemblies (i.e., at the ends disposed relatively distal to the actuator).

It will, therefore, be apparent to one of skill in the art that engineering of the positions, shapes, strengths and other characteristics of the individual magnets and/or magnetic regions along the respective lengths of the magnetic assemblies, as well as the characteristics of elasticity, flexibility, etc. of the magnetic assemblies respectively will address these issues. Thus, for example, the placement of magnets will be varied in certain embodiments to compensate for stretching or compression that occurs as the actuator or connecting cable is operating. In addition, mechanical features will be included in certain embodiments of the invention that strengthen the overall strength and operability of the closure.

Figure 8A:
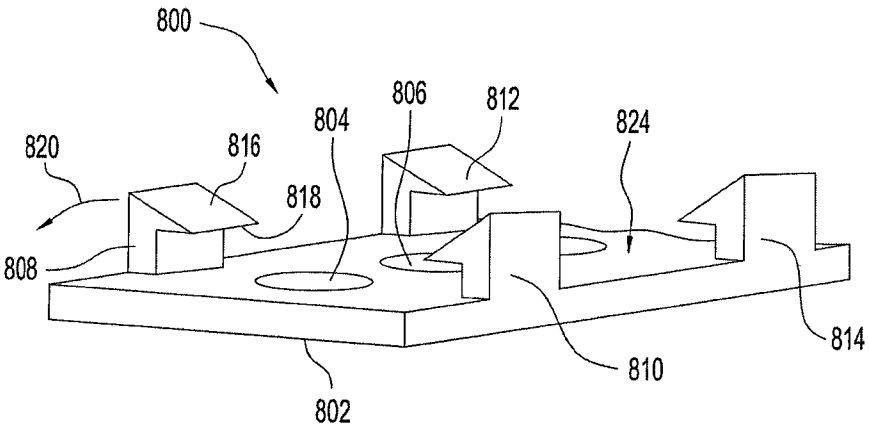
FIG. 8A shows, in schematic perspective view, certain aspects of mechanically enhanced magnetic assembly of a closure prepared according to principles of the invention.
Figure 8B:
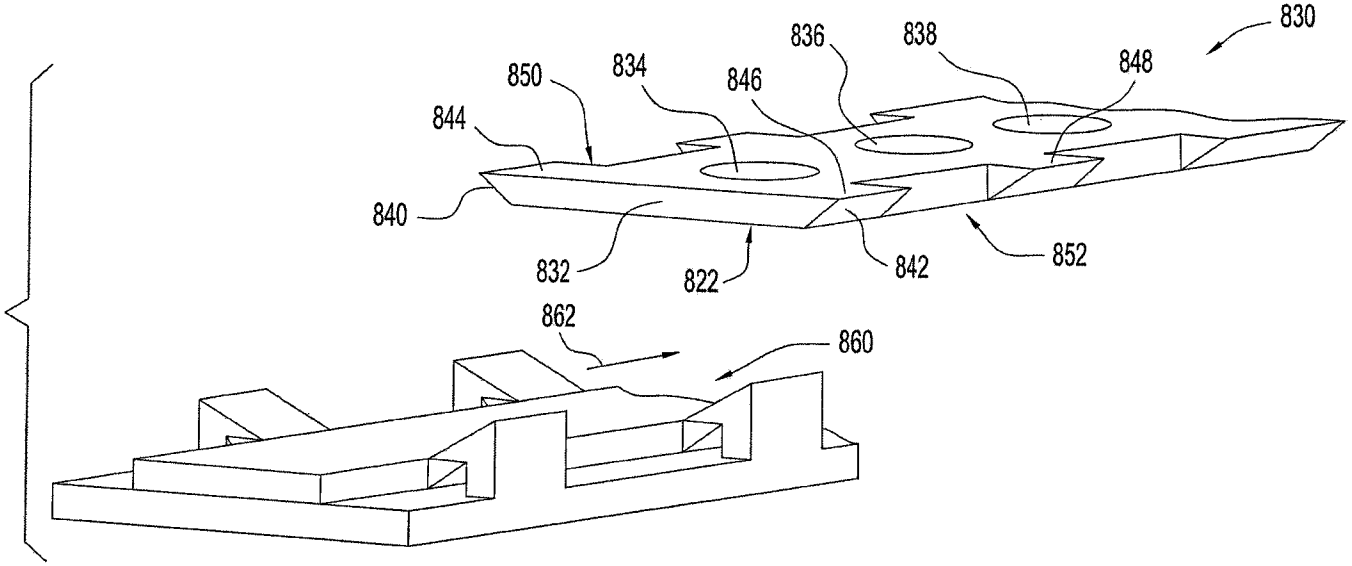
FIG. 8B shows, in schematic perspective view, certain further aspects of a mechanically enhanced magnetic assembly for a closure prepared according to principles of the invention.

Accordingly, FIGS. 8A and 8B show, in schematic perspective view, one exemplary mechanical structure and arrangement that increases the strength, improves the release timing, avoids buckling of the magnetic assemblies, and otherwise improves the overall operation of the closure.

FIG. 8A shows a first magnetic assembly 800 for a magnetic closure prepared according to principles of the invention. The magnetic assembly 800 includes a structural member 802 and a plurality of magnets, e.g., 804, 806. The structural member 802 includes a plurality of barbed features, e.g., 808, 810, 812, 814. Each barbed feature includes an inclined entry surface e.g., 816, and a retention surface e.g., 818. It will be noted that each barbed feature is desirably elastic, and able to deflect in a direction 820 in response to appropriate forces applied to, for example, inclined entry surface 816.

FIG. 8B shows a second magnetic assembly 830. The second magnetic assembly 830 includes a structural member 832 and a plurality of magnets, e.g., 834, 836, 838. The structural member 832 includes a plurality of inclined surface regions, e.g., 840, 842 and a plurality of retention surface regions 844, 846.

A peripheral edge 848 of the structural member 832 defines a plurality of recesses (or notches) 850, 852. The recesses 850, 852 are disposed adjacent alternating magnets, e.g., 836, while the peripheral edge 848 is not recessed adjacent the other magnets, e.g., 838.

With further reference to FIG. 5 above, and considering the magnetic assemblies 800, 830 just described, it will be apparent that a closure according to principles of the invention can be arranged such that, when closing, attractive magnetic forces between respective magnets, e.g., 804 and 834 of magnetic assemblies 800, 830 respectively, will tend to urge surface regions, e.g., 840 and 816 against each other with the result that barbed feature 808 deflects substantially elastically in direction 820 until surface region 822 of magnetic assembly 830 is substantially in contact with surface region 824 of magnetic assembly 800 (as shown, e.g., at 860). At this point, elastic resilience of the barbed feature 808 will cause it to return to its relaxed position and surface region e.g., 818 will be disposed in contact with surface region e.g., 844, resulting in the barbed feature retaining the two magnetic assemblies 800, 830 in proximity to one another.

Thereafter, the release operation of the closure described above will tend to slide the two magnetic assemblies 800, 830 longitudinally 862 with respect to one another until the recesses 850, 852 align with the barbed features 808, 810, at which point magnetic forces between the magnets will tend to push the two magnetic assemblies apart from one another. According to this arrangement, the additional feature of the barbs will tend to increase the closure strength of the closure of the present invention, and to prevent premature release of the closure (and buckling of the magnetic members) during the release operation.

It will be appreciated by one of skill in the art, that the mechanical structures of FIGS. 8A and 8B are merely exemplary of a wide variety of mechanical structures that will be included and applied in respective embodiments and applications of the invention. The wide variety of mechanical structures will include, for example, hooks and loops, conventional zipper teeth including, for example, conventional projections and cups and/or a conventional zipper slider, (where the zipper slider may be advanced and retracted by action of the magnetic closure), textile hook and loop fasteners, snaps, and any other mechanical enhancement to the closure of the present invention that is known or becomes known in the art.

Figure 9:
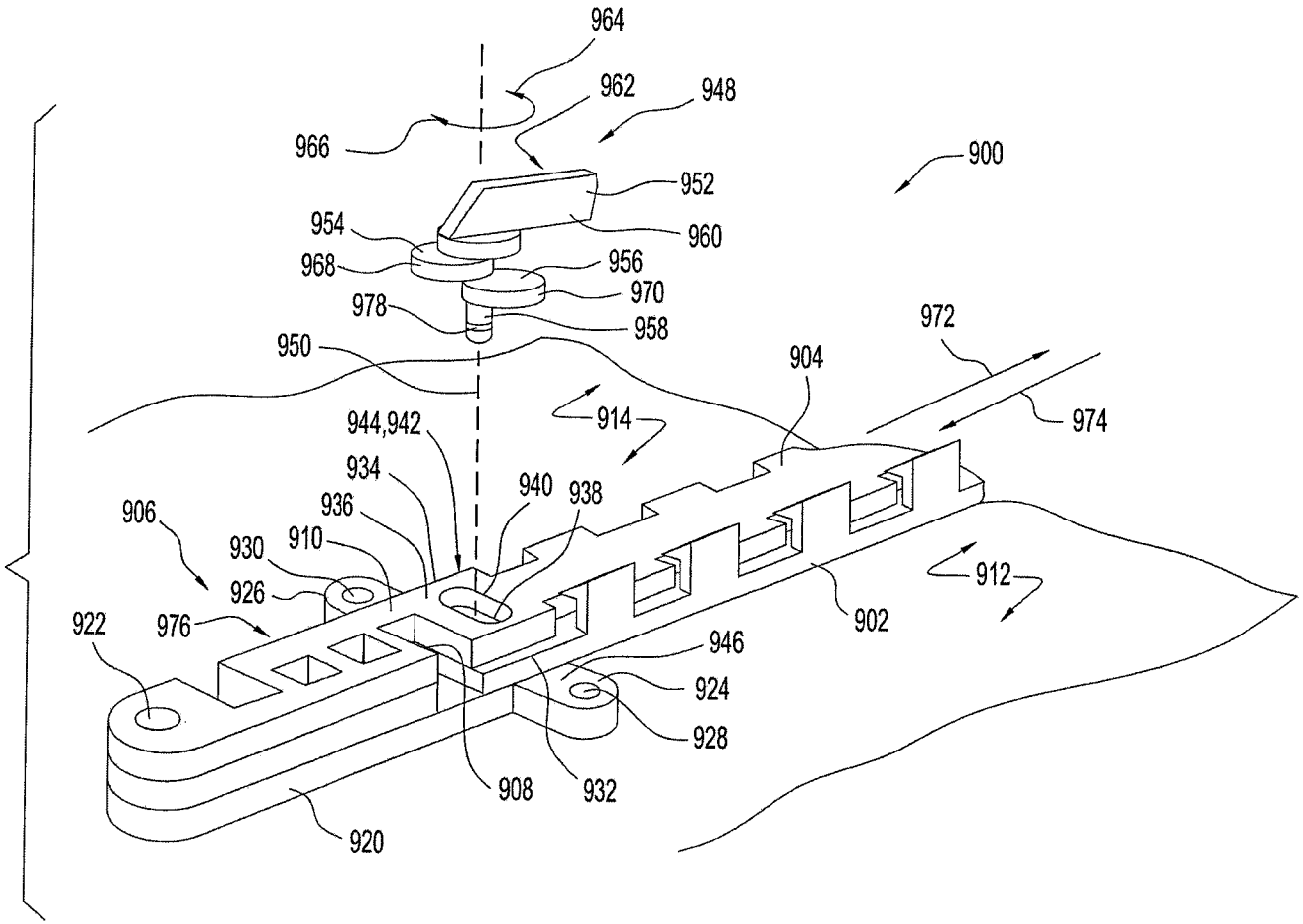
FIG. 9 shows, in exploded schematic perspective view, certain further aspects of a mechanically enhanced closure prepared according to principles of the invention, including a cam-operated actuator portion.

FIG. 9 shows in exploded cutaway perspective view certain further aspects of a closure 900 prepared according to principles of the invention. Closure 900 includes a first magnet portion 902 and a second magnet portion 904. An actuator 906 includes a first coupling member 908 associated with the first magnet portion 902. The actuator 906 also includes a second coupling member 910 associated with the second magnet portion 904.

The first magnet portion 902 is mechanically coupled to a first portion 912 of a substrate. The second magnet portion 904 is mechanically coupled to a second portion 914 of the substrate.

It will be appreciated by one of skill in the art, that actuator portion 906 is merely exemplary of a wide variety of actuators to produce respective desirable rearrangements and/or reconfigurations of the magnetic elements of the magnetic portions 902, 904. For clarity of presentation, actuator 906 is shown in transition between open and closed states in FIG. 9.

Actuator 906 includes a base portion 920. The base portion 920 includes coupling hole 922, and flange features 924, 926. Flange features 924, 926 have respective further coupling holes 928, 930.

One of skill in the art will understand that coupling holes 922, 928 and 930 are adapted to receive respective fasteners, where the fasteners serve to couple the base portion 906 to respective regions of the substrate. In respective implementations and/or embodiments of the invention, the fasteners will include, without limitation and only by way of example, threaded and/or unthreaded fasteners such as any of tubular and semi-tubular rivets, solid rivets, pop rivets, snap rivets, flush rivets, self piercing rivets, drive rivets, rivnuts, trifold exploding rivets, double cap rivets, grommets, binding screws, EPDM internally threaded expansion nuts, and screws and/or screws and nuts of any variety. In addition, the desired coupling will be achieved, in respective embodiments, by the application of a physical or chemical adhesive, an adhesive tape, thermal welding, ultrasonic welding, or any other coupling and/or connecting method that is known or becomes known in the art, including combinations of any of the foregoing.

As illustrated, the first magnetic portion 902 includes a first cam receiver portion 932 and the second magnetic portion 904 includes a second cam receiver portion 934.

Each cam receiver portion 932, 934 includes a respective upper surface region, e.g., 936 having respective internal circumferential edges, 938, 940. The internal circumferential edges 938, 940 define respective elongate bores or apertures 942, 944 through the cam receiver portions 932, 934 respectively.

A further substantially circular bore is defined by a respective substantially circular internal circumferential edge of an upper surface region 946 of the base portion 920. The further substantially circular bore is disposed below (as pictured) and generally aligns with elongate bores 942 and 944. Accordingly, a cam lever device 948 is adapted to be disposed within the respective bores of the base 920, the first cam receiver portion 932 and the second cam receiver portion 934 along the indicated axis 950.

As exemplified by the illustrated cam lever device 948, in certain embodiments of the invention, a cam lever device will include a lever portion 952, a first generally circular eccentric cam 954, a second generally circular eccentric cam 956 and a shaft extension portion 958. As one of skill in the art will ascertain upon inspection of FIG. 9 cams 954 and 956 are offset from axis 950 in respectively opposite directions, and thus eccentric with respect to that axis. Shaft extension 958 is disposed substantially coaxially with axis 950, and align with one end of lever portion 952, such that, when in operation, respective forces applied to surface regions 960, 962 of lever portion 952 will urge lever device 948 into respective rotations 964, 966 about axis 950.

One of skill in the art will appreciate that, when operatively assembled, cam 956 will be substantially aligned with bore 942 of receiver portion 932 and cam 954 will be substantially aligned with bore 944 of receiver portion 934. Consequently, upon rotation 964, 966 of lever portion 952 an external circumferential surface region 968 of cam 954 will tend to impinge on the corresponding internal surface region of bore 944 and an external surface region 970 of cam 956 will tend to impinge on the corresponding internal surface region of bore 942, thereby urging magnetic portions 904 and 902 in opposite directions, e.g., 972, 974 respectively.

In light of the description provided above with respect to FIGS. 2A, 2B, 3A and 3B, one of skill in the art will immediately appreciate the manner in which the compliant apparatus 976 (including link members and living hinges) of base portion 906 will permit, in robust and repetitive fashion, these respective motions 972, 974 of magnet portions 904 and 902. Of course, it will be appreciated by one of skill in the art, that the selection of generally circular cams 954, 956 represent engineering choices made for a particular application, and that a wide variety of other cam configurations will be appropriate, and applied as needed, in alternative embodiments. It is to be understood that all of these various configurations and embodiments are intended to be disclosed by the present writing, and are intended to be included within the scope of the present invention.

It will likewise be appreciated by the reader that, in certain embodiments of the invention, surfaces 960, 962 of lever portion 952 will be intended for direct manual operation of the lever device by the application of, for example, the fingers of a user to those surfaces of the cam lever device 948. In other embodiments of the invention, cam lever device 948 will be remotely operated by, for example, a cable, or an actuator, whether mechanical, electromechanical, piezoelectric, or otherwise coupled to the lever portion 952. In still other embodiments of the invention, lever portion 952 will be replaced, for operation of the cam lever device 948, by any other appropriate transmission device such as, for example, a pinion gear, a further cam element, a ratchet wheel, or any other mechanism known or hereinafter discovered in the art, including combinations thereof.

It will also be noted that, in certain embodiments prepared according to principles of the invention, the shaft extension portion 958 will include, for example, a groove 978 for receiving, e.g., a retaining snap ring. When in operation, this retaining snap ring is disposed outwardly of a surface region of base portion 920, thereby retaining cam lever device 948 in the operative arrangement, with respect to the balance of the apparatus, as suggested above. Naturally, other devices will be employed in respective further embodiments of the invention including, for example, screws, rivets, plastic deformation of an end of the shaft portion 958, adhesive and/or welding application of a retainer element to the end of shaft portion 958, or any other appropriate retaining mechanism that is known or becomes known in the art, and including combinations of the foregoing.

Figure 10A:
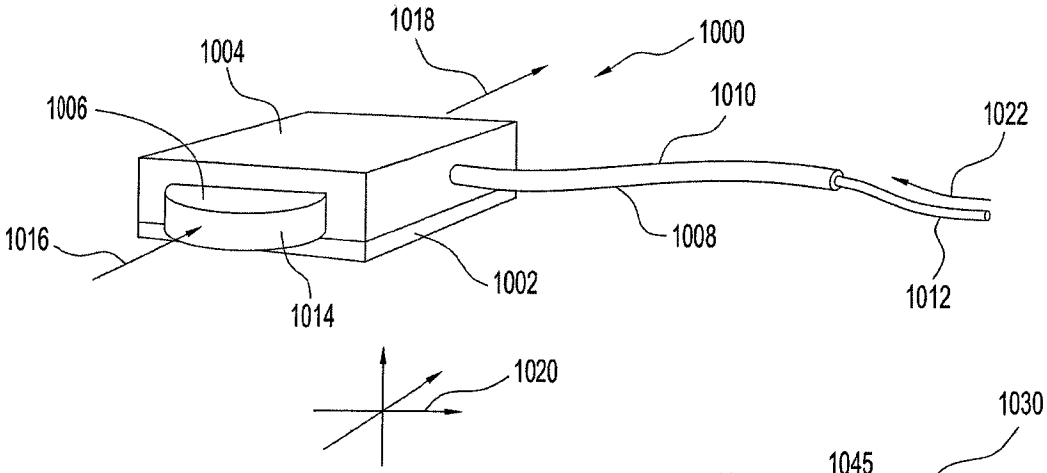
FIG. 10A shows, in schematic perspective view, further aspects of an exemplary remote actuator portion of a closure prepared according to principles of the invention.

FIG. 10A shows, in schematic perspective view, a portion of a closure prepared according to principles of the invention. In particular, FIG. 10A illustrates aspects of an exemplary remote actuator 1000 of an actuator portion of such a closure. The illustrated remote actuator portion 1000 includes a base 1002, a housing 1004, and a button member 1006. A cable assembly 1008 including, for example, an external cable housing 1010 and a generally flexible internal tensile member 1012 is operatively coupled to the remote actuator 1000 in a manner further described below.

The button member 1006 includes a contact surface region 1014 that is adapted, during operation, to be placed in contact with an external element, whereby the external element is able to apply a force 1016 urging the button member 1006 (and causing it to move) in a direction 1018 with respect to a frame of reference 1020 of the remote actuator 1000. The external element may be a shoe, a table leg, a bedpost, a chair leg, a cane, or any other device able to apply the requisite force 1016 to the button member 1006. By virtue of the mechanism of the remote actuator 1000, this relative motion of the button member 1006 results in a corresponding motion 1022 of the tensile member 1012 with respect to the external cable housing 1010 of the cable assembly 1008.

When considered in relation to FIG. 7A above, the reader will immediately appreciate that remote actuator 1000 is similar in its general form and operation to remote actuator 710 of closure 702; that button member 1006 is related to button member 715; that direction 1018 is related to direction 716; and that tensile member 1012 is related to cable 712. Of course, the reader will appreciate that remote actuator 1000 and remote actuator 710 are both merely exemplary of a wide variety of apparatus, arrangements and configurations that will be applied according to principles of the invention in relation to respective embodiments.

Moreover, it will be appreciated that any or all of the exemplary elements, e.g., base 1002 and housing 1004, are merely illustrative of elements that will be provided in certain embodiments of the invention. In other embodiments, for example, these elements and others will be omitted in favor of, for example and without any intention to be limiting, integral aspects of a heel of a shoe, or other item, in which the closure is employed.

Figure 10B:
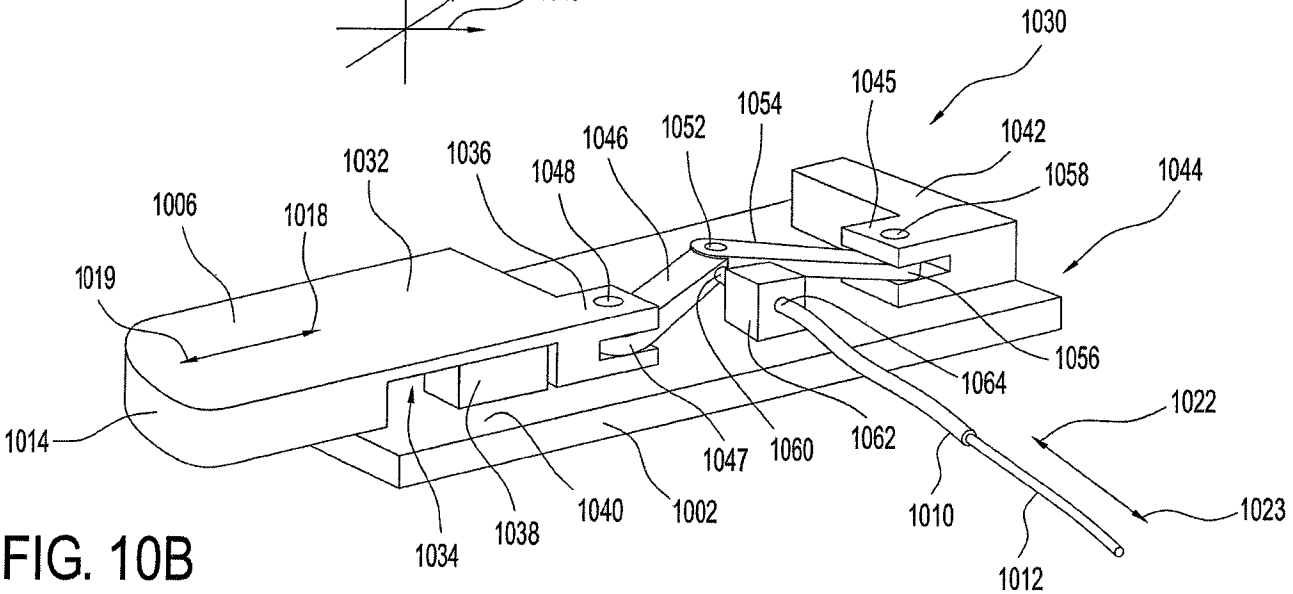
FIG. 10B shows, in schematic perspective view, further internal aspects of an exemplary remote actuator portion of a closure prepared according to principles of the invention.

FIG. 10B shows, in schematic perspective view, further exemplary aspects of a remote actuator 1030 of a closure prepared according to principles of the invention. As shown, the remote actuator 1030 includes a base 1002 and button member 1006. The illustrated button member 1006 includes a contact surface region 1014 at a proximal end thereof, an upper surface region 1032, a lower surface region 1034, and a clevis portion 1036 at a distal end thereof. A linear bearing 1038 is operatively coupled between an upper surface region 1040 of the base 1002, and the lower surface region 1034 of the button member 1006. One of skill in the art will appreciate that linear bearing 1038 serves to support button member 1006 for generally linear motion in directions 1018 and 1019 with respect to base 1002. Other embodiments of the invention will include pivotal rather than linear button motion.

A ground member 1042 is disposed at a distal end 1044 of the base 1002. The ground member 1042 includes a second clevis 1045.

A first link member 1046 has a proximal end 1047 that is pivotally coupled to clevis 1036 through a first clevis pin 1048. A distal end of link member 1046 is pivotally coupled through a second clevis pin 1052 to a proximal end of a second link member 1054. A distal end 1056 of the second link member 1054 is pivotally coupled to second clevis 1045 through a further, clevis pin 1058.

One end 1060 of tensile member 1012 is operatively coupled, directly or indirectly, to the pivotal arrangement formed by link members 1046 and 1054, and clevis pin 1052. Correspondingly, a cable anchor 1062 is coupled to base 1002 as shown. The cable anchor 1062 has a slot, recess or bore therethrough, and a portion of the tensile member 1012 is disposed within the slot, recess or bore. An end region 1064 of external cable housing 1010 is coupled to and/or supported by cable anchor 1062 so as to be functionally immobile with respect to base 1002.

As will be further clarified below, operation of the button member 1006 results in respective pivotal motions of link members 1046 and 1054 that in turn draw and release tensile member 1012 in directions 1022 and 1023.

Figure 11B:
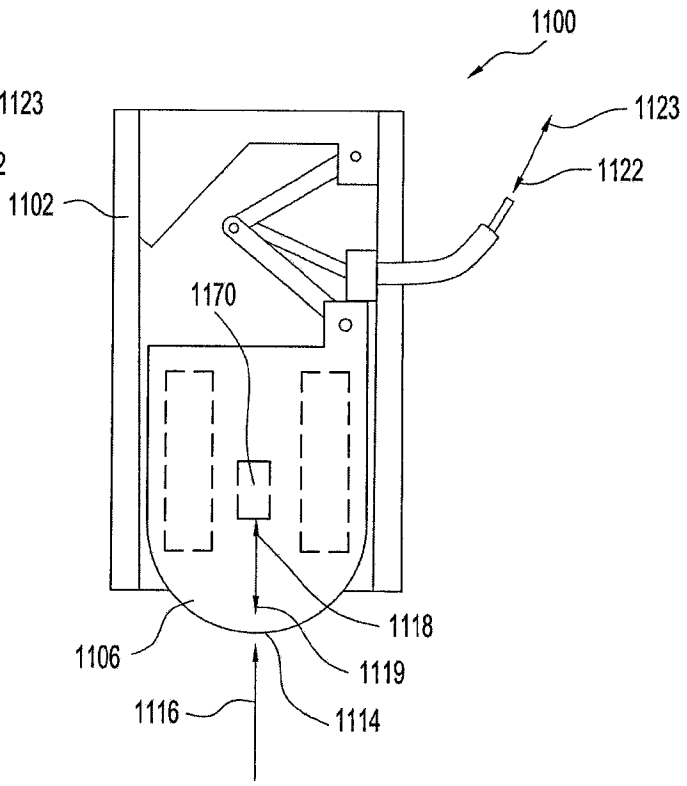
FIG. 11B shows, in schematic perspective view, further operative aspects and methods of operation of an exemplary remote actuator portion of a closure prepared according to principles of the invention in a second operative state.
Figure 11A:
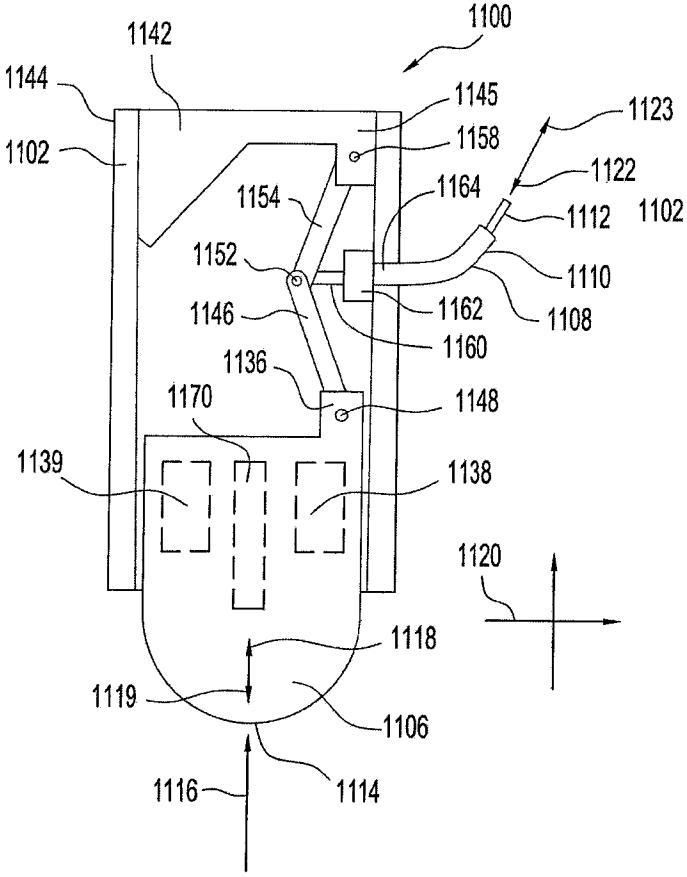
FIG. 11A shows, in schematic perspective view, further operative aspects and methods of operation of an exemplary remote actuator portion of a closure prepared according to principles of the invention in a first operative state.

FIGS. 11A and 11B further illustrate the structure and operation of an exemplary remote actuator 1100 for a closure prepared according to principles of the invention. It will be apparent to one of skill in the art that remote actuator 1100 is similar in many respects to remote actuator portion 1000 and remote actuator 710.

The illustrated remote actuator 1100 includes a base 1102, and a button member 1106. A cable assembly 1108 including, for example, an external housing 1110 and a generally flexible internal tensile member 1112 is operatively coupled to the remote actuator 1100 in a manner further described below.

First and second linear bearings 1138, 1139 are operatively coupled between respective upper surface regions of the base 1102, and lower surface regions of the button member 1106. One of skill in the art will appreciate that linear bearing 1138 serves to support button member 1106 for generally linear motion in directions 1118 and 1119 with respect to base 1102.

The button member 1106 includes a contact surface region 1114 that is adapted, during operation, to be placed in contact with an external element, whereby the external element is able to apply a force 1116 urging the button member 1106 (and causing it to move) in a direction 1118, in respect to a frame of reference 1120 of the remote actuator 1100. By virtue of the mechanism of the remote actuator 1100, this relative motion of the button member 1106 results in a corresponding translation 1122 of the tensile member 1112 with respect to the external housing 1110 of the cable assembly 1108.

Like remote actuator 1000, described above, remote actuator 1100 includes a ground member 1142 disposed at a distal end 1144 of the base 1102. The button member 1106 includes first clevis 1136 and the ground member 1142 includes a second clevis 1145.

A first link member 1146 has a proximal end that is pivotally coupled to clevis 1136 through a first clevis pin 1148. A distal end of link member 1146 is pivotally coupled through a second clevis pin 1152 to a proximal end of a second link member 1154. A distal end of the second link member 1154 is pivotally coupled to the second clevis 1145 through a further, clevis pin 1158.

One end 1160 of tensile member 1112 is operatively coupled, directly or indirectly, to the pivotal arrangement formed by link members 1146 and 1154, and clevis pin 1152. Correspondingly, A cable anchor 1162 is coupled to base 1102 as shown. The cable anchor 1162 has a slot, recess or bore therethrough, and a portion of the tensile member 1112 is disposed within the slot, recess or bore. An end region 1164 of external housing 1110 is coupled to and/or supported by cable anchor 1162 so as to be functionally immobile with respect to base 1102.

Upon comparison of FIGS. 11A and 11B, the practitioner of ordinary skill in the art will immediately appreciate that FIG. 11A shows remote actuator 1100 and a first operative state and 11B shows the same remote actuator 1100 in a second operative state. In the first operative state of FIG. 11A, the tensile member 1112 is relatively extended in direction 1123, whereas in the second operative state of FIG. 11B the tensile member is relatively retracted (i.e., in direction 1122).

In certain embodiments of the invention, a bi-stable latch mechanism 1170 is operatively coupled between the base 1102, and the button member 1106. The bi-stable latch mechanism 1170 serves to temporarily secure button member 1106 in the location shown in FIG. 11B (i.e. in a second operative state) when the remote actuator 1100 is placed into the illustrated configuration. Thereafter, the application of a further pressure to button surface region 1114 causes release of the bi-stable latch mechanism so that the remote actuator returns to the its first operative state.

Accordingly, one of skill in the art will appreciate that the remote actuator 1100 exhibits two stable operative states and two transient operative states. FIG. 11A shows remote actuator 1100 in a first stable operative state. The remote actuator 1100 will remain in this first state until a force 1116 is applied to surface region 1114. Responsive to this force, remote actuator 1100 enters a first transient operative state as the button element 1106 moves into the configuration shown in FIG. 11B. As it arrives at this new configuration, the bi-stable latch 1170 latches and the remote actuator 1100 enters a second stable operative state, where it remains until force 1116 is once again applied to surface region 1114. The further application of force 1116 to surface region 1114 causes the bi-stable latch 1170 to release, and the remote actuator 1100 enters a second transient operative state. During the second transient operative state, the button member 1106 moves back in direction 1119 until he returns to the first operative state, as shown in FIG. 11B.

When viewed in conjunction with, for example, the illustration of FIGS. 7A and 7B, one of skill in the art will appreciate that, in certain embodiments, the first stable operative state of remote actuator 1100 is consistent with a closed state of a corresponding closure, whereas the second operative state of remote actuator 1100 is consistent with an open state of the corresponding closure. At the same time, it should be appreciated that alternative embodiments of the invention will employ different arrangements to achieve the desired outcomes. For example, in certain embodiments, the stable operative state shown in FIG. 11B will correspond to a closed state of a corresponding closure.

The bi-stable latch 1170 will, in certain embodiments of the invention, include an integrated bi-stable latch device such as, for example, the "uxcell Touch Catch Magnetic Press Latch for Cabinet Door Cupboard Drawers" (available for purchase via Amazon.com at https://www.amazon.com/gp/product/B07TVMG79V) or, for example, the "DonYoung Push to Open Door Latch Magnetic Push Latches" (available for purchase via Amazon.com at https://www.amazon.com/dp/B0B1HV143H). One of skill in the art will appreciate, however, that in other embodiments of the invention a specially designed bi-stable latch will be applied. In certain such embodiments, the bi-stable latch will be formed as an integral portion of the remote actuator and/or the local actuator of the closure. In various respective embodiments, the bi-stable actuator will include any a wide variety of bi-stable elements including, for example, mechanical ratchet elements, electronic bi-stable elements, bimetallic bi-stable elements, and any other element or design appropriate to a particular inventive embodiment, and combinations thereof. All of the foregoing latching arrangements are intended to be disclosed by the present recitation, and are believed to fall within the scope of the present invention.

It will be appreciated by one of skill in the art that, while the exemplary apparatus of FIG. 10B, 11A and 11B show pivotal linkages including clevis pins, alternative embodiments of the invention will employ any appropriate rigid and/or hinge element and combinations of the same such as, for example and without limitation, one or more compliant elements such as, for example, polymer living hinges. Indeed, any mechanism appropriate to produce the indicated motion of the tensile member (and/or the above-described action of the closure) will be applied in a corresponding embodiment of the invention, and is intended to be disclosed to one of skill in the art by the examples presented herewith.

Figure 12:
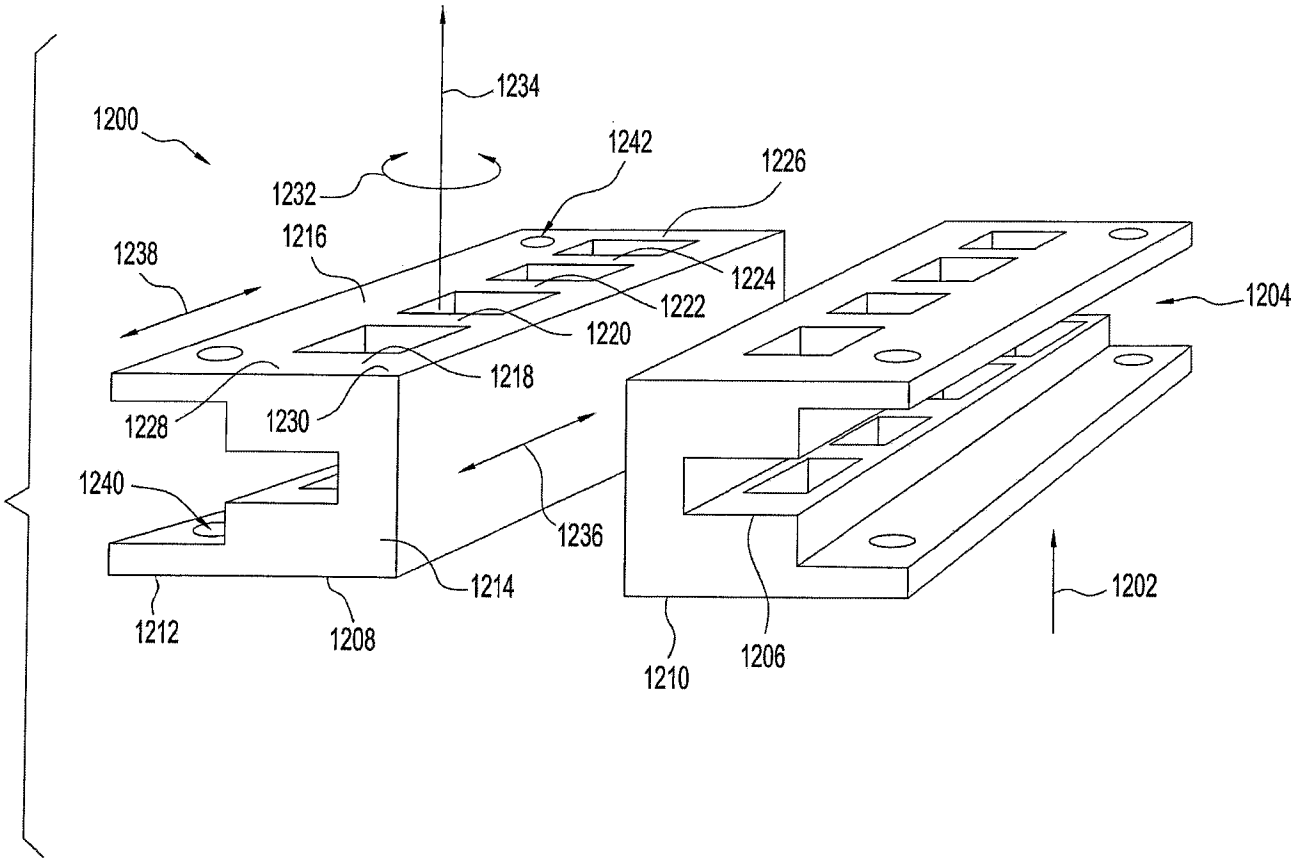
FIG. 12 shows, in schematic perspective view, further aspects of an exemplary remote actuator portion of a closure prepared according to principles of the invention, including a translational linear bearing thereof.

FIG. 12 shows, in schematic perspective view, certain aspects of a closure prepared according to principles of the invention, including an exemplary linear translator 1200. Having reviewed, for example, the descriptions above related to FIGS. 11A and 11B, the practitioner of skill in the art will appreciate that the illustrated linear translator 1200 will be beneficially applied as linear bearings 1138 and 1139 in certain respective embodiments of the invention.

Linear translator 1200 is shown to include a compliant mechanism that has certain advantages including durability and limited parts count, as well as the potential to be manufactured in a manner including certain desirable manufacturing processes such as, for example, polymer injection molding and/or polymer extrusion. For example, in certain embodiments, according to principles of the invention, an extrusion will be produced in direction 1202 with a secondary process that develops a slot 1204 defined by an edge 1206, and separates individual elements using, for example and without limitation, machine cutting operations.

Linear bearing 1200 includes first and second body portions 1208, 1210. It will be appreciated however that, in certain embodiments, a single body portion will suffice for a respective application. Thus, while the illustrated embodiment of linear translator 1200 includes 2 body portions, alternative embodiments will include one body portion, three body portions, four body portions, or any number of body portions deemed to be appropriate and/or optimal to the requirements of a particular application of the invention. The exemplary body portion 1208 includes a first static member portion 1212, a second dynamic member portion 1214, and a third dynamic member portion 1216.

As is apparent upon inspection, each body portion includes a plurality of link elements e.g., 1218, 1220, 1222, 1224 and 1226. Each link element has a first end, e.g., 1228 and a second and e.g., 1230. A hinge element is disposed at each of the respective ends, e.g., 1228, 1230, thereby permitting, when in operation, a pivotal motion, e.g., 1232 of the respective link element about a respective pivotal axis 1234 of the link element. Corresponding to these pivotal motions of the respective link elements, the second dynamic member portion e.g., 1214 and third dynamic member portion e.g., 1216 will exhibit respective generally linear motions 1236, 1238.

In certain embodiments of the invention, the static member portion 1212 and dynamic member portion, e.g., 1216 will include, for example, bores, e.g., 1240, 1242 for receiving respective fasteners, such as rivets, screws, eyelets or other attachment devices. Thus, a first external element will, in certain embodiments of the invention, be attached to the static member portion 1212 and a second external element will be attached to the dynamic member portion 1216, and the first and second external elements will be thus configured to move in a generally linear motion, reflecting a combination of motions 1236 and 1238, with respect to one another.

It will be appreciated by one of skill in the art that the above-indicated attachment means are only exemplary, and that any of a wide variety of fasteners such as rivets, screws, etc. will be employed, as well as, in respective embodiments, chemical and/or physical adhesives, physical attachments, welding, such as thermal welding, ultrasonic welding, arc welding, or any other attachment process that is known or becomes known in the art. Moreover, in certain embodiments of the invention, the linear bearing will be produced as an integral aspect of a unit where the above-described generally linear motion is desirable.

It will also be appreciated that, while in certain desirable embodiments of the invention, the hinges noted above are formed as living polymer hinges, any other hinging device, such as, for example and without limitation, a clevis pin hinging device will be employed to good effect, and that all examples and combinations of such, and examples and combinations yet to be discovered, are intended to fall within the scope of the present disclosure.

Figure 13:
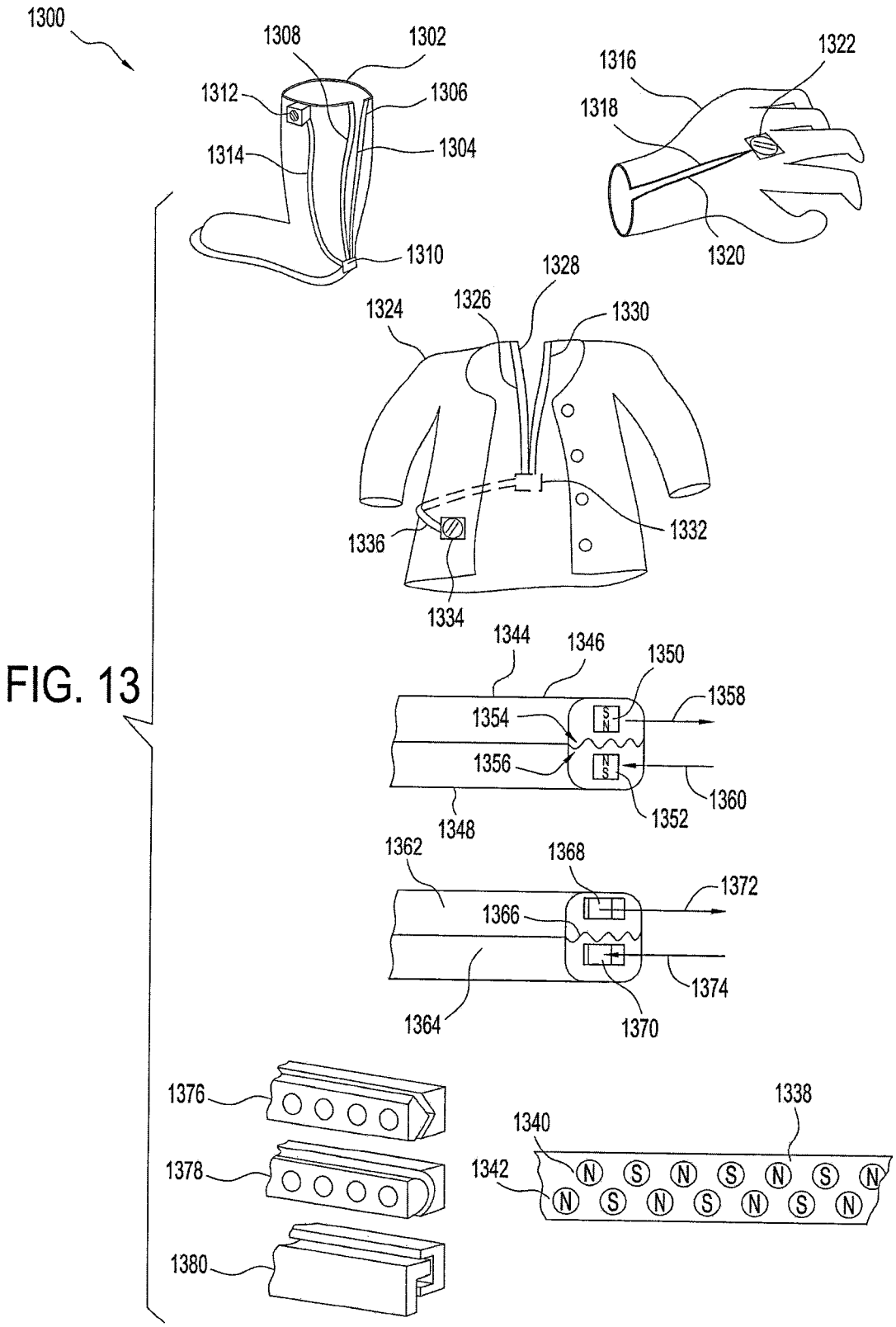
FIG. 13 shows, in schematic perspective view, further aspects and various exemplary applications of a plurality of closures prepared according to principles of the invention in their respective uses.

FIG. 13 shows, in schematic perspective view, further aspects and various exemplary applications of a plurality of closures 1300 prepared according to principles of the invention in their respective uses. For example, an exemplary boot 1302 includes a closure 1304 prepared according to principles of the invention. Exemplary closure 1304 includes a first magnetic assembly 1306, a second magnetic assembly 1308, a local actuator 1310 and a remote actuator 1312, where the remote actuator 1312 is operatively coupled 1314 to the local actuator 1310.

Also shown in FIG. 13 is an exemplary glove 1316. Glove 1316 includes a closure 1318 prepared according to principles of the invention. The closure 1318 includes a first magnetic element and a second magnetic element 1320, with the first magnetic element and the second magnetic element are mutually coupled at respective distal ends thereof to an actuator 1322.

Also shown in FIG. 13 is an exemplary coat 1324. Coat 1324 exemplifies without limitation in overcoat, a lab coat, jacket, vest, or any other garment. Coat 1324 includes a closure 1326 prepared according to principles of the invention. Exemplary closure 1326 includes a first magnetic assembly 1328, a second magnetic assembly 1330, a local actuator 1332 and a remote actuator 1334, where the remote actuator 1334 is operatively coupled 1336 to the local actuator 1332.

Also shown in FIG. 13 is a portion of a closure 1338 prepared according to principles of the invention. Portion 1338 illustrates that a magnetic element or assembly of a closure prepared according to principles of the invention will include, in respective embodiments, magnets and/or magnetic regions in various arrangements. Here, first 1340 and second 1342 rows of magnets are present, offset from one another in the longitudinal axis of the portion 1338. It will be appreciated by one of skill in the art, however, that this is merely exemplary of many possible arrangements of magnets that fall within the scope of the present disclosure. Accordingly, magnets and magnetic regions may be arranged in patterns of 1, 2, or 3 dimensions, and in any other way beneficial to achieving the goals and objectives set forth above.

Also shown in FIG. 13 is a portion of a closure 1344 prepared according to principles of the invention. Closure 1344 includes a first magnetic assembly 1346 and a second magnetic assembly 1348. Magnetic assemblies 1346 and 1348 include respective magnetic regions 1350, 1352 and respective interdigitated surface regions 1354, 1356 adapted to maintain, for example, a fluid seal when the magnetic closure 1344 is in its closed configuration. In certain embodiments of the invention, the magnetic assemblies 1346 and 1348 will include an elastomeric material.

As illustrated, magnetic assemblies 1346 and 1348 are adapted to move with respect to each other, e.g., 1358, 1360 in the manner described above in relation to the invention as a whole. In contrast, magnetic assemblies 1362, 1364 include an interdigitated seal 1366 like that provided by interdigitated surface regions 1354, 1356 described above. However, magnetic assemblies 1362 and 1364 include respective internal medic subassemblies 1368, 1370 that are respectively mobile 1372, 1374 within magnetic assembly 1362, 1364. Accordingly, the magnetic assemblies 1362 and 1364 illustrated can transition from an opened configuration to a close configuration without the longitudinal motion (e.g., 1358, 1360) experience that surface regions 1354, 1356.

FIG. 13 also shows magnetic assemblies 1376, 1378, 1380 having a variety of respective cross-sectional profiles appropriate to providing sealing and/or offer structural and operational benefits in respective embodiments of the invention. Of course, one of skill in the art will appreciate that these are merely exemplary of a plethora of possible arrangements suggested by the present disclosure and all of which are intended to fall within the scope of the present disclosure.

While the exemplary embodiments described above have been chosen primarily from the field of human garments, one of skill in the art will appreciate that the principles of the invention are equally well applied, and that the benefits of the present invention are equally well realized in a wide variety of other closure systems including, for example, closures for draperies, doors, packaging, luggage, and any other system having an aperture or other mechanism suitable for operation by the closure described here with. Further, while the invention has been described in detail in connection with the presently preferred embodiments, it should be readily understood that the invention is not limited to such disclosed embodiments. Rather, the invention can be modified to incorporate any number of variations, alterations, substitutions, or equivalent arrangements not heretofore described, but which are commensurate with the spirit and scope of the invention. Accordingly, the invention is not to be seen as limited by the foregoing description, but is only limited by the scope of the appended claims.

The invention claimed is:

1. A closure comprising:

a first structural member having a first longitudinal axis, a second structural member having a second longitudinal axis, and an actuator mechanism, said actuator mechanism coupled to respective first ends of said first and second structural members;

said first structural member having a first plurality of magnets, said first plurality of magnets having respective magnetic polarities and respective magnetic axes disposed generally transverse to said first longitudinal axis, said respective magnetic polarities being disposed in alternating fashion along said first longitudinal axis;

said second structural member having a second plurality of magnets, said second plurality of magnets having respective magnetic polarities and respective magnetic axes disposed generally transverse to said second longitudinal axis, said respective magnetic polarities being disposed in alternating fashion along said second longitudinal axis;

said actuator mechanism including a body and a third structural member, said third structural member including a pivotal link, said third structural member being coupled to said body and to said first structural member so as, when under an actuating force, to urge said first structural member from a first spatial position into a second spatial position whereby said respective polarities of said first and second pluralities of magnets transition from respective states of mutual attraction to mutual opposition.

2. A closure as defined in claim 1 wherein said third structural member is coupled to said body and to said first structural member so as to translate said first structural member from a first spatial position into a second spatial position in a direction generally parallel to said first longitudinal axis.

3. A closure as defined in claim 1 wherein said third structural member is coupled to said body and to said first structural member so as to rotate said first structural member from a first spatial position into a second spatial position in a generally rotational motion around said first longitudinal axis.

4. A closure as defined in claim 1 wherein said first plurality of magnets comprises a plurality of discrete magnets disposed within a discrete structural support member.

5. A closure as defined in claim 1 wherein said first plurality of magnets comprises a plurality of magnetized regions magnetized within an integral structural support member.

6. A closure as defined in claim 1 wherein said plurality of magnets comprises a plurality of discrete magnets coupled to one another in order to form said first structural member.

7. A closure as defined in claim 6 wherein said structural member comprises a plurality of separators disposed respectively between respective pairs of said plurality of discrete magnets.

8. A closure as defined in claim 7 wherein at least one of said plurality of separators comprises at least one elastomeric polymer material.

9. A closure as defined in claim 8 wherein at least one of said plurality of separators comprise at least one molded-in-place elastomeric polymer material.

10. A closure as defined in claim 7 wherein at least one of said plurality of separators comprises a universal joint.

11. A closure as defined in claim 7 wherein at least one of said plurality of separators comprises a generally helical coupling.

12. A closure as defined in claim 7 wherein at least one of said plurality of separators comprises an orienting ball joint.

13. A closure as defined in claim 7 wherein at least one of said plurality of separators comprises an orienting flange.

14. A closure as defined in claim 7 wherein said plurality of separators comprises any combination of one or more separator including an elastomeric polymer material, one or more separator including a molded-in-place elastomeric polymer material, one or more separator including a universal joint, one or more separator including a generally helical coupling, one or more separator including an orienting ball joint, and one or more separator including an orienting flange.

15. A closure as defined in claim 1 wherein said actuator mechanism further comprises an input pedal and an input shaft, said input shaft being operatively coupled between said input pedal and said third structural member, such that an external force applied to a surface region of said input pedal is coupled through said input shaft to said third structural member so as to apply said actuating force to said third structural member.

16. A closure as defined in claim 1 wherein said third structural member comprises a linear link.

17. A closure as defined in claim 1 wherein said third structural member comprises a pinion gear.

18. A closure as defined in claim 1 wherein said third structural member comprises a bell crank.

19. A closure device comprising:

a first structural member having a first longitudinal axis, a second structural member having a second longitudinal axis, and an actuator mechanism, said actuator mechanism coupled to respective first ends of said first and second structural members;

said first structural member having a first plurality of magnets, said first plurality of magnets having respective magnetic polarities and respective magnetic axes disposed generally transverse to said first longitudinal axis, said respective magnetic polarities being disposed in alternating fashion along said first longitudinal axis;

said second structural member having a second plurality of magnets, said second plurality of magnets having respective magnetic polarities and respective magnetic axes disposed generally transverse to said second longitudinal axis, said respective magnetic polarities being disposed in alternating fashion along said second longitudinal axis;

said actuator mechanism including a body and a third structural member, said third structural member being coupled to said body and to said first structural member so as, when under an actuating force, to urge said first structural member from a first spatial position into a second spatial position whereby said respective polarities of said first and second pluralities of magnets transition from respective states of mutual attraction to mutual opposition; and wherein said first and second longitudinal axes define a plane therebetween, and wherein at least one of said first and second structural members includes at least one flexible element, said flexible element being adapted to allow said at least one structural member to flex preferentially in a direction of said plane.

* * * * *